US011195489B2

(12) United States Patent
Mamba

(10) Patent No.: US 11,195,489 B2
(45) Date of Patent: Dec. 7, 2021

(54) DISPLAY DEVICE

(71) Applicant: Japan Display Inc., Tokyo (JP)

(72) Inventor: Norio Mamba, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/004,654

(22) Filed: Aug. 27, 2020

(65) Prior Publication Data

US 2021/0065644 A1 Mar. 4, 2021

(30) Foreign Application Priority Data

Aug. 30, 2019 (JP) ..... JP2019-158819

(51) Int. Cl.
*G09G 3/36* (2006.01)

(52) U.S. Cl.
CPC ..... *G09G 3/3677* (2013.01); *G09G 3/3688* (2013.01); *G09G 2310/0297* (2013.01); *G09G 2330/021* (2013.01)

(58) Field of Classification Search
None
See application file for complete search history.

(56) References Cited

U.S. PATENT DOCUMENTS 6,628,259 B2 * 9/2003 Hashimoto ..... G09G 3/3688 345/98
2008/0309599 A1 12/2008 Tsuda et al.
2011/0050670 A1 * 3/2011 Kim ..... G05F 1/46 345/211
2014/0125716 A1 5/2014 Kurokawa et al.
2014/0362042 A1 * 12/2014 Noguchi ..... G06F 3/0412 345/174
2016/0049111 A1 * 2/2016 Lee ..... G09G 3/3258 345/691
2017/0236471 A1 * 8/2017 Ota ..... G09G 3/3258 345/76

FOREIGN PATENT DOCUMENTS

JP 2004-029540 A 1/2004
JP 4152420 B2 9/2008

* cited by examiner

*Primary Examiner* — Dorothy Harris
(74) *Attorney, Agent, or Firm* — K&L Gates LLP

(57) ABSTRACT

A display device, comprising: a plurality of pixels arranged in a matrix (row-column configuration) in a display area; a scanning line that is coupled to each of the pixels aligned in a row direction in the display area, and to which a scanning signal is supplied; a signal line that is coupled to each of the pixels aligned in a column direction in the display area, and to which a pixel signal is supplied; a gate driver that supplies the scanning signal to the scanning line; a signal selection circuit that separates the pixel signal that is time-division multiplexed to an image signal; a first control signal output circuit that outputs a first control signal supplied to the gate driver; and a second control signal output circuit that outputs a second control signal supplied to the signal selection circuit.

7 Claims, 19 Drawing Sheets

DISPLAY DEVICE

CROSS-REFERENCE TO RELATED APPLICATIONS

This application claims priority from Japanese Application No. 2019-158819, filed on Aug. 30, 2019, the contents of which are incorporated by reference herein in its entirety.

BACKGROUND

1. Technical Field

The present disclosure relates to a display device.

2. Description of the Related Art

In recent years, there are demands for increasing the resolution and narrowing the frame of a liquid crystal display device used for a portable electronic apparatus such as a smartphone. Consequently, a structure capable of performing a high-speed operation by using low-temperature polycrystalline silicon (LTPS), or a structure that reduces the number of output terminals of the driver IC, by driving a plurality of sub-pixels forming one pixel in a time-division manner is sometimes used. For example, a technology for driving two or more pixels (six sub-pixels) in a time-division manner has been disclosed (for example, Japanese Patent No. 4152420). In general, when the time-division driving is performed, to reduce the on-resistance and increase the driving force of a transistor or a field effect transistor (FET) that forms a signal selection circuit, the voltage of a control signal of the signal selection circuit is level shifted to the voltage for driving a panel, and the signal is output from the driver IC (for example, Japanese Patent Application Laid-open Publication No. 2004-029540).

Switching noise in the signal selection circuit is propagated to a panel drive circuit via a power supply line, and causes radiation noise. The control frequency of the signal selection circuit is increased with an increase in the resolution and the number of time division. More specifically, the control frequency of the signal selection circuit is a value obtained by multiplying the display frequency per pixel that is determined by the frame rate, by the number of time division. Consequently, for example, high-frequency radiation noise may affect the radio frequency (RF) circuit and the like in the portable electronic apparatus and the like, and may cause problems such as reduction in reception sensitivity.

SUMMARY

It is an object of the present disclosure to at least partially solve the problems in the conventional technology.

A display device according to one embodiment of the present disclosure includes a plurality of pixels arranged in a matrix (row-column configuration) in a display area, a scanning line that is coupled to each of the pixels aligned in a row direction in the display area, and to which a scanning signal is supplied; a signal line that is coupled to each of the pixels aligned in a column direction in the display area, and to which a pixel signal is supplied, a gate driver that supplies the scanning signal to the scanning line, a signal selection circuit that separates the pixel signal that is time-division multiplexed to an image signal, a first control signal output circuit that outputs a first control signal supplied to the gate driver, and a second control signal output circuit that outputs a second control signal supplied to the signal selection circuit. At least one of the gate driver, the first control signal output circuit, and the second control signal output circuit performs a display operation, when power of a first power supply is supplied, voltage of the first power supply being boosted by a boosting circuit.

DETAILED DESCRIPTION

Figure 1:
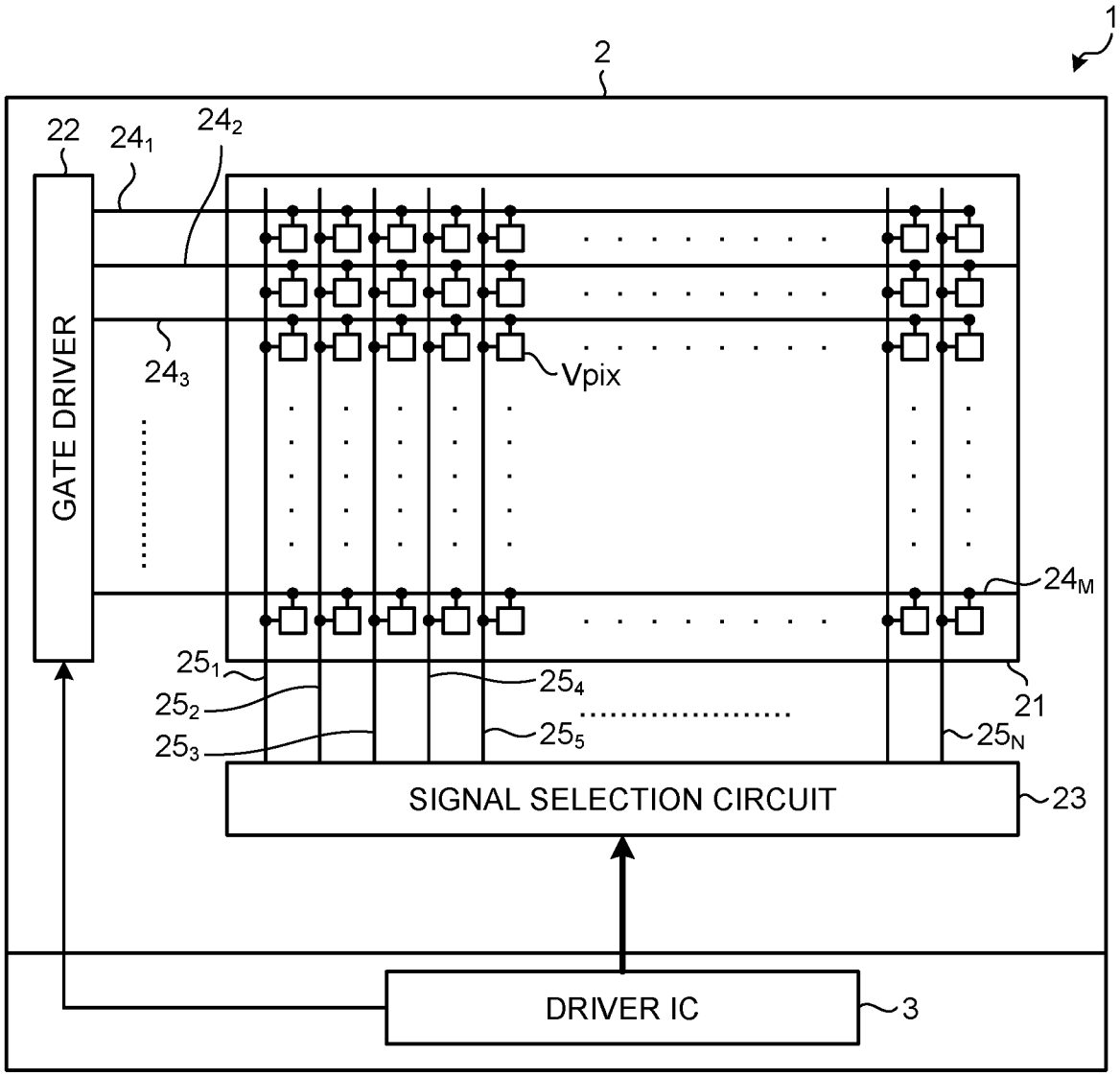
FIG. 1 is a block diagram illustrating an example of a system configuration of a display device according to a first embodiment.

Hereinafter, modes (embodiments) for carrying out the disclosure will be described in detail with reference to the accompanying drawings. However, the present disclosure is not limited to the contents described in the following embodiments. Components described below include components that can be easily assumed by those skilled in the art and components substantially the same as those components. Moreover, the components described below can be combined with one another as appropriate. The disclosure is merely an example, and the present disclosure naturally encompasses an appropriate modification maintaining the gist of the disclosure that is easily conceivable by those skilled in the art. To further clarify the description, a width, a thickness, a shape, and the like of each component may be schematically illustrated in the drawings as compared with an actual aspect. However, the drawings are merely examples, and do not limit the interpretations of the present disclosure in any way. In the present specification and drawings, the same reference numerals denote the same components as those in the drawings that have already been discussed, and detailed description thereof may be omitted as appropriate.

First Embodiment

FIG. 1 is a block diagram illustrating an example of a system configuration of a display device 1 according to a first embodiment.

For example, the display device 1 is a liquid crystal display panel. In the embodiment, the display device 1 is not limited to the liquid crystal display panel. For example, the display device 1 may also be an organic electroluminescence (EL) display using an organic light emitting diode (OLED) as a display element. The display device 1 may also be an inorganic EL display using an inorganic light emitting diode (micro LED) as a display element. The display device 1 may also be an electrophoretic display (EPD).

For example, the display device 1 may be a device integrated with a capacitive touch sensor. For example, when the capacitive touch sensor is built in and integrated with the display device 1, parts of members such as a substrate and electrodes for displaying are commonly used as parts of members such as a substrate and electrodes for a touch sensor. Alternatively, for example, the display device 1 may be what is called an on-cell type device in which a capacitive touch sensor is mounted. The present disclosure is not limited to the mode of the display device 1.

As illustrated in FIG. 1, the display device 1 includes a display panel 2 and a driver integrated circuit (IC) 3.

The display panel 2 includes a liquid crystal layer interposed between a layered translucent insulating substrate (for example, a glass substrate) and the substrate. The display panel 2 also includes a display area 21 where a large number of pixels Pix (see FIG. 2) including liquid crystal cells are arranged in a matrix (row-column configuration), a gate driver (vertical drive circuit) 22, the driver IC 3, a signal selection circuit 23, and the like. The glass substrate includes a first substrate and a second substrate. In the first substrate, a large number of pixel circuits including active elements (for example, transistors) are arranged in a matrix (row-column configuration). The second substrate is arranged opposite to the first substrate at a predetermined gap. The gap between the first substrate and the second substrate is maintained at a predetermined gap, by a plurality of photo-spacers arranged and formed at various locations on the first substrate. Liquid crystals are sealed between the first substrate and the second substrate. The layout and size of the units such as the display area 21 on the display panel 2 illustrated in FIG. 1 are schematic, and do not reflect the actual layout and the like.

The display area 21 has a matrix structure (row-column configuration) in which a plurality of sub-pixels Vpix including a liquid crystal layer are arranged in M rows and N columns. In this specification, a row refers to a pixel row including N pieces of sub-pixels Vpix arranged in one direction. A column refers to a pixel column including M pieces of sub-pixels Vpix arranged in a direction orthogonal to the direction toward which the rows are arranged. Values of M and N are determined according to the display resolution in the vertical direction and the display resolution in the horizontal direction.

In the display area 21, with respect to the sub-pixels Vpix arranged in M rows and N columns, scanning lines $\mathbf{24}_1$, $\mathbf{24}_2$, $\mathbf{24}_3$, . . . , and $\mathbf{24}_M$ are arranged in rows, and signal lines $\mathbf{25}_1$, $\mathbf{25}_2$, $\mathbf{25}_3$, . . . , and $\mathbf{25}_N$ are arranged in columns. Hereinafter, in the first embodiment, the scanning lines $\mathbf{24}_1$, $\mathbf{24}_2$, $\mathbf{24}_3$, . . . , and $\mathbf{24}_M$ may be referred to as a scanning line 24, and the signal lines $\mathbf{25}_1$, $\mathbf{25}_2$, $\mathbf{25}_3$, . . . , and $\mathbf{25}_N$ may be referred to as a signal line 25. In the first embodiment, any three scanning lines among the scanning lines $\mathbf{24}_1$, $\mathbf{24}_2$, $\mathbf{24}_3$, . . . , and $\mathbf{24}_M$ are expressed as scanning lines $\mathbf{24}_m$, $\mathbf{24}_{m+1}$, and $\mathbf{24}_{m+2}$ (however, m is a natural number satisfying $m \leq M-2$), and any four signal lines among the signal lines $\mathbf{25}_1$, $\mathbf{25}_2$, $\mathbf{25}_3$, . . . , and $\mathbf{25}_N$ are expressed as signal lines $\mathbf{25}_n$, $\mathbf{25}_{n+1}$, $\mathbf{25}_{n+2}$, and $\mathbf{25}_{n+3}$ (however, n is a natural number satisfying $n \leq N-3$).

A video signal is input to the display device 1 from outside, and is supplied to the driver IC 3. The driver IC 3 is an integrated circuit that generates an image signal output in units of 1H (H is a horizontal period) corresponding to one line (one pixel row) on the basis of the video signal, and that outputs the image signal to the signal selection circuit 23. More specifically, the driver IC 3 generates an image signal obtained by time-division multiplexing the pixel signal output to each of the sub-pixels Vpix forming each of the pixels Pix.

The driver IC 3 has a function of generating a vertical synchronization signal and a horizontal synchronization signal according to a master clock that are reference signals for controlling the synchronization of the circuits. The driver IC 3 also has a function of synchronizing and controlling the gate driver 22, the signal selection circuit 23, and the like. More specifically, the driver IC 3 generates first control signals (start pulse signal SP and shift clock pulse signal SCK), which will be described below, and outputs the first control signals to the gate driver 22. The driver IC 3 also generates second control signals (signal selection switch control signals ASW and XASW), which will be described below, and outputs the second control signals to the signal selection circuit 23.

On the basis of the second control signals (start pulse signal SP and shift clock pulse signal SCK), the gate driver 22 generates a scanning signal, and sequentially selects the sub-pixel Vpix row by row, by applying the scanning signal to the scanning line 24 (scanning lines $\mathbf{24}_1$, $\mathbf{24}_2$, $\mathbf{24}_3$, . . . , and $\mathbf{24}_M$) in the display area 21. For example, the gate driver 22 sequentially outputs the scanning signals from the upper side of the display area 21 of the scanning lines $\mathbf{24}_1$, $\mathbf{24}_2$, . . . (side further away from the driver IC 3), which is the upstream side in the vertical scanning direction, toward the lower side of the display area 21 (side close to the driver IC 3), which is the downstream side in the vertical scanning direction. The gate driver 22 may also sequentially output the scanning signals from the lower side of the display area 21 of the scanning lines $\mathbf{24}_M$, . . . , which is the downstream side in the vertical scanning direction, toward the upper side of the display area 21, which is the upstream side in the vertical scanning direction.

The signal selection circuit 23 distributes the image signal output from the driver IC 3 to a sub-pixel Vpix. More specifically, on the basis of the first control signals (signal selection switch control signals ASW and XASW), the signal selection circuit 23 separates the time-division multiplexed pixel signal to the image signal of each column, for the image signals of a plurality of columns.

The signal selection circuit 23 may have a structure in which the signal selection circuit 23 is formed inside an IC chip, and the IC chip is provided on a translucent insulating substrate of the display panel 2. The signal selection circuit 23 may also have a structure in which the signal selection circuit 23 is formed on the translucent insulating substrate. In the first embodiment, the signal selection circuit 23 has a structure in which a circuit is formed on the translucent insulating substrate.

Figure 2:
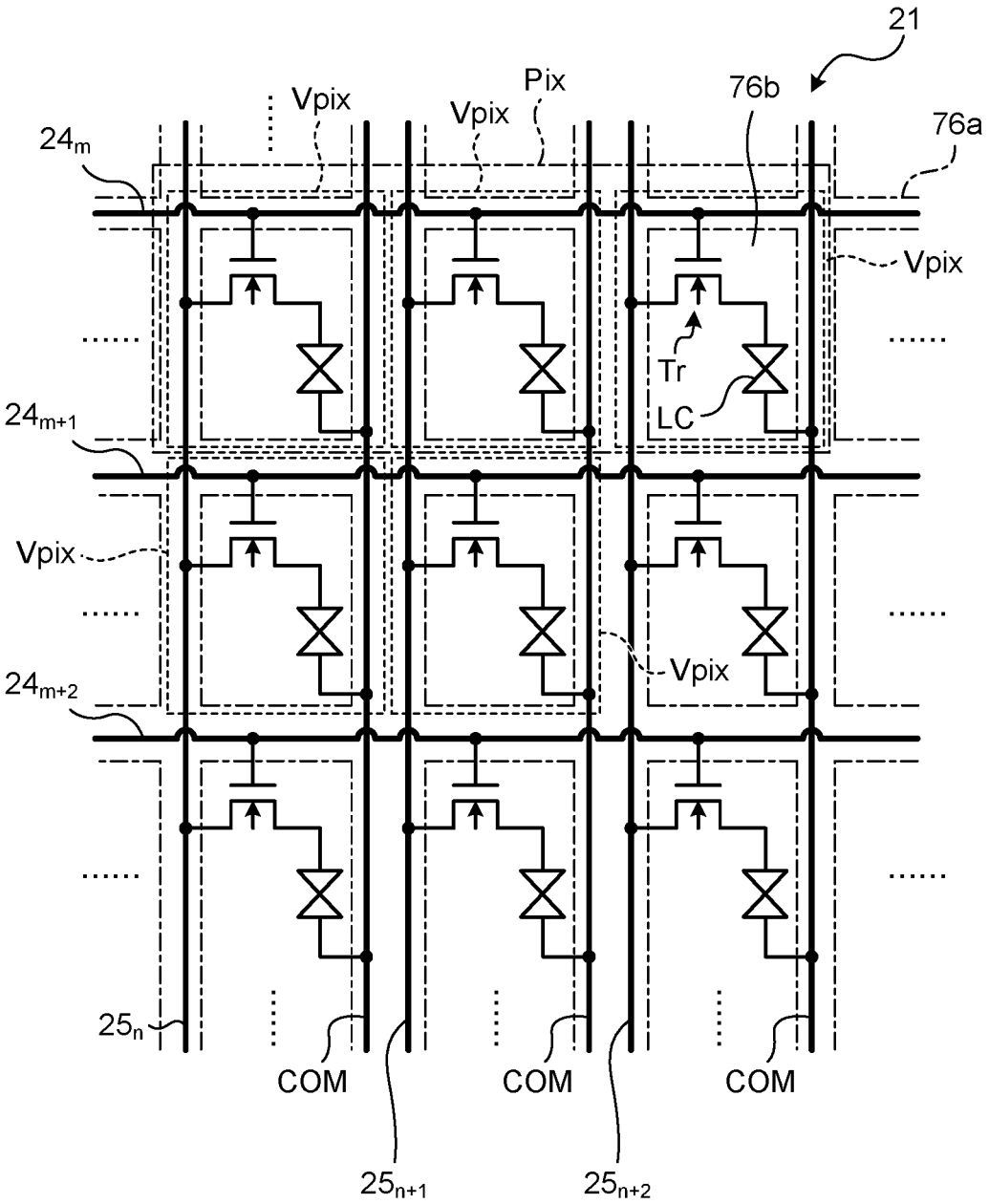
FIG. 2 is a circuit diagram illustrating a drive circuit that drives pixels of the display device according to the first embodiment.

FIG. 2 is a circuit diagram illustrating a drive circuit that drives pixels Pix of the display device 1 according to the first embodiment. Wiring such as the signal lines $\mathbf{25}_n$, $\mathbf{25}_{n+1}$, and $\mathbf{25}_{n+2}$ that supply a pixel signal to a thin film transistor (TFT) element Tr of the sub-pixel Vpix, as display data, the scanning lines $\mathbf{24}_m$, $\mathbf{24}_{m+1}$, and $\mathbf{24}_{m+2}$ that drive each TFT element Tr, and the like are formed on the display area 21. In this manner, the signal lines $\mathbf{25}_n$, $\mathbf{25}_{n+1}$, and $\mathbf{25}_{n+2}$ extend on a flat surface in parallel with the surface of the glass substrate described above, and supply pixel signals for displaying an image on the sub-pixels Vpix. The sub-pixels Vpix include a TFT element Tr and a liquid crystal element LC. The TFT element Tr is formed of a thin film transistor, and in this example, is formed of an n-channel metal oxide semiconductor (MOS) TFT. One of the source and drain of the TFT element Tr is coupled to the signal lines $\mathbf{25}_n$, $\mathbf{25}_{n+1}$, and $\mathbf{25}_{n+2}$, the gate is coupled to the scanning lines $\mathbf{24}_m$, $\mathbf{24}_{m+1}$, and $\mathbf{24}_{m+2}$, and the other of the source and drain is coupled to an end of the liquid crystal element LC. One end of the liquid crystal element LC is coupled to the other of the source and drain of the TFT element Tr, and the other end of the liquid crystal element LC is coupled to a common electrode COM.

Through the scanning lines $\mathbf{24}_m$, $\mathbf{24}_{m+1}$, and $\mathbf{24}_{m+2}$, the sub-pixel Vpix is coupled to the other sub-pixel Vpix in the same row in the display area 21. The scanning lines $\mathbf{24}_m$, $\mathbf{24}_{m+1}$, and $\mathbf{24}_{m+2}$ are coupled to the gate driver 22, and vertical scanning pulses of the scanning signal are supplied from the gate driver 22. Through the signal lines $\mathbf{25}_n$, $\mathbf{25}_{n+1}$, and $\mathbf{25}_{n+2}$, the sub-pixel Vpix is coupled to the other sub-pixel Vpix in the same column in the display area 21. The signal lines $\mathbf{25}_n$, $\mathbf{25}_{n+1}$, and $\mathbf{25}_{n+2}$ are coupled to the signal selection circuit 23, and an image signal is supplied via the signal selection circuit 23. Through the common electrode COM, the sub-pixel Vpix is coupled to the other sub-pixel Vpix in the same column in the display area 21. The common electrode COM is coupled to a common electrode drive circuit, which will be described below, and a drive signal is supplied by a common potential VCOM output from the common electrode drive circuit. In the present embodiment, the driver IC 3 includes the common electrode drive circuit, and has a function to output the common potential VCOM.

The gate driver 22 illustrated in FIG. 1 sequentially selects one row (one horizontal line) of the sub-pixels Vpix arranged in a matrix (row-column configuration) in the display area 21 as a display driving target, by applying a gate signal to the gate of the TFT element Tr of the sub-pixel Vpix, via the scanning lines $\mathbf{24}_m$, $\mathbf{24}_{m+1}$, and $\mathbf{24}_{m+2}$ illustrated in FIG. 2. The driver IC 3 supplies a pixel signal to the sub-pixels Vpix including the one horizontal line sequentially selected by the gate driver 22, via the signal lines $\mathbf{25}_n$, $\mathbf{25}_{n+1}$, and $\mathbf{25}_{n+2}$ illustrated in FIG. 2. Then, the one horizontal line is displayed on the sub-pixels Vpix according to the supplied pixel signal.

As described above, in the display device 1, one horizontal line is sequentially selected, when the gate driver 22 is driven so as to sequentially scan the scanning lines $\mathbf{24}_m$, $\mathbf{24}_{m+1}$, and $\mathbf{24}_{m+2}$. For the sub-pixels Vpix in the one horizontal line, the display device 1 transmits a pixel signal to the display area 21 under the control of the driver IC 3. Consequently, the horizontal line is displayed line by line.

In the first embodiment, a column inversion driving method is used as a driving method of the pixels Pix provided in the display area 21 of the display device 1, which is a liquid crystal display device. The column inversion driving method is a driving method in which the polarity of the pixel signal output to the display area 21 is inverted column by column (one pixel column).

Other known driving methods include a line inversion driving method, a dot inversion driving method, a frame inversion driving method, and the like. The line inversion driving method is a driving method in which the polarity of the pixel signal is inverted every 1H period (H is a horizontal period) corresponding to one line (one pixel row). The dot inversion driving method is a driving method in which the polarity of the pixel signal is inverted for each of the sub-pixels in the vertical and horizontal directions that are disposed adjacent to each other. The frame inversion driving method is a driving method in which pixel signals to be written into all sub-pixels are inverted to the same polarity at the same time for each frame corresponding to one screen. The display device 1 may use any driving method described above.

The display area 21 includes a color filter. The color filter includes a black matrix 76*a* formed in a lattice shape and an opening part 76*b*. As illustrated in FIG. 2, the black matrix 76*a* is formed so as to cover the outer periphery of the sub-pixel Vpix. In other words, the black matrix 76*a* is formed in a lattice shape, by being placed on the boundary between the sub-pixel Vpix and the sub-pixel Vpix that are arranged two-dimensionally. The black matrix 76*a* is formed of a material having a high light absorption rate. The opening part 76*b* is an opening formed by the lattice of the black matrix 76*a*, and is arranged corresponding to the sub-pixel Vpix.

For example, the opening part 76*b* includes a color region corresponding to sub-pixels of three colors for output. More specifically, for example, the opening part 76*b* includes a color region colored in three colors of red (R), green (G), and blue (B) that are modes of first color, second color, and third color. For example, on the opening part 76*b* of the color filter, color regions colored in three colors of red (R), green (G), and blue (B) are periodically arranged along the row direction. In the first embodiment, the color region of three colors of R, G, and B is associated with each of the sub-pixels Vpix illustrated in FIG. 2, as the pixel Pix as a set.

In this manner, the display panel 2 functions as a display unit that includes a plurality of the pixels (pixels Pix) in which the sub-pixels (sub-pixels Vpix) of red (R), green (G), and blue (B) for output are arranged, and that includes the display area (for example, the display area 21) where the pixels are arranged in a matrix (row-column configuration).

The colors of the sub-pixels Vpix and the combination of colors are not limited to those described in the above example, and may be modified as appropriate. For example, the colors of the sub-pixels Vpix may be four or more, or may be two or less. More specifically, when the fourth color is white (W), the white (W) opening part 76*b* will not be colored by the color filter. When the fourth color is another color, the color used as the fourth color is colored by the color filter. The same applies to the fifth color and thereafter. When the color of the sub-pixels Vpix is two or less, the color may be other than R, G, and B. The sub-pixel Vpix may be a pixel corresponding to what is called a monochromatic display. In this case, the color of the sub-pixel Vpix may be white (W), and the one pixel Pix may be formed of one sub-pixel Vpix.

In the display area 21, when viewed from the direction orthogonal to the front, the scanning lines 24 and the signal lines 25 are arranged in an area overlapping with the black matrix 76*a* of the color filter. In other words, when viewed from the direction orthogonal to the front, the scanning lines 24 and the signal lines 25 are hid behind the black matrix 76*a*. In the display area 21, an area where the black matrix 76*a* is not disposed is the opening part 76*b*.

As illustrated in FIG. 2, the scanning lines $\mathbf{24}_m$, $\mathbf{24}_{m+1}$, and $\mathbf{24}_{m+2}$ are arranged at equal intervals, and the signal lines $\mathbf{25}_n$, $\mathbf{25}_{n+1}$, and $\mathbf{25}_{n+2}$ are also arranged at equal intervals. The sub-pixels Vpix are disposed in areas partitioned by the scanning lines $\mathbf{24}_m$, $\mathbf{24}_{m+1}$, and $\mathbf{24}_{m+2}$ and the signal lines $\mathbf{25}_n$, $\mathbf{25}_{n+1}$, and $\mathbf{25}_{n+2}$ facing the same direction.

Figure 3:
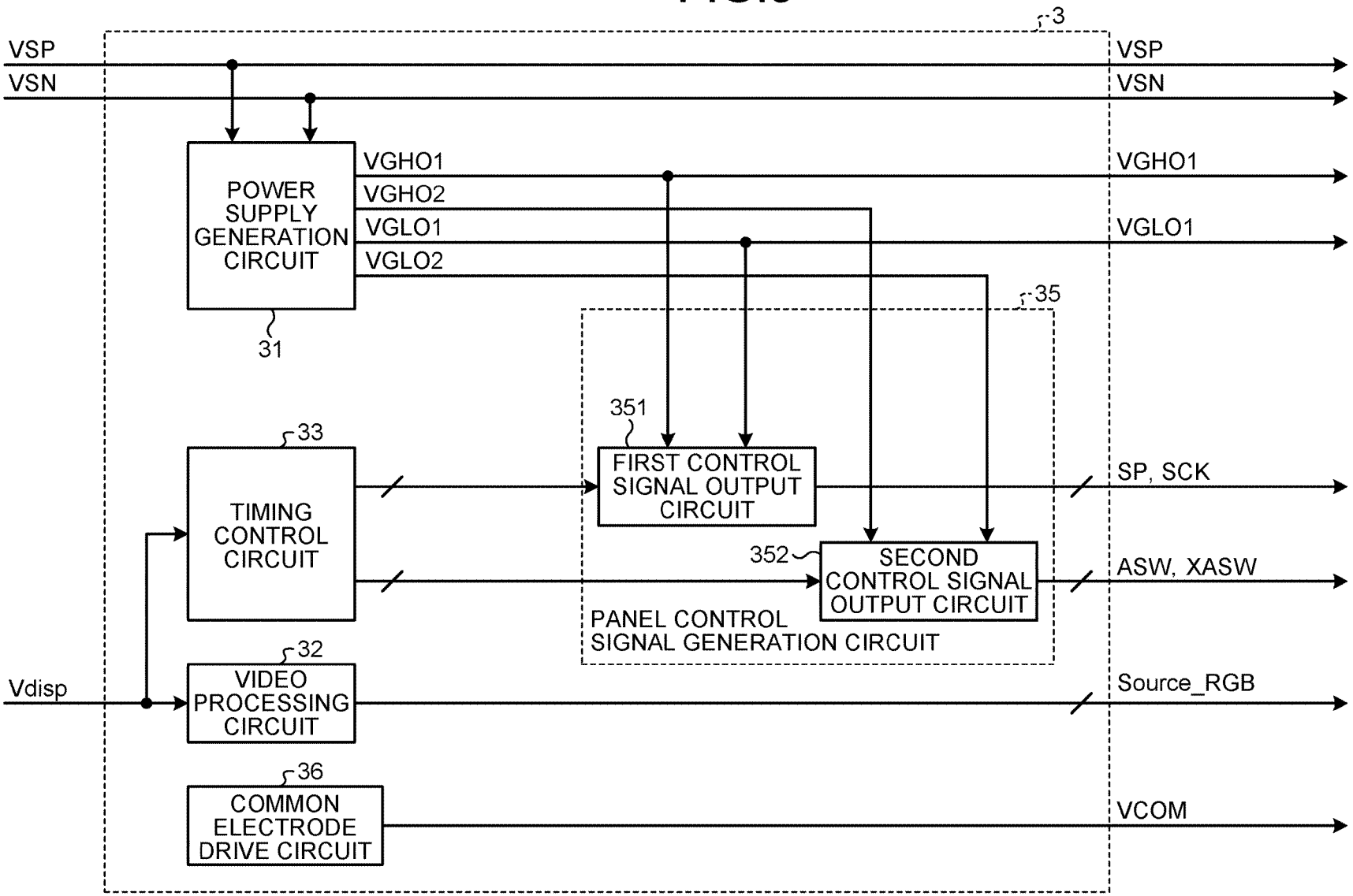
FIG. 3 is a diagram illustrating an example of an internal block configuration of a driver IC of the display device according to the first embodiment.

FIG. 3 is a diagram illustrating an example of an internal block configuration of a driver IC of the display device according to the first embodiment. As the internal block configuration illustrated in FIG. 3, the driver IC 3 includes a power supply generation circuit 31, a video processing circuit 32, a timing control circuit 33, a panel control signal generation circuit 35, and a common electrode drive circuit 36. The video processing circuit 32 processes a video signal Vdisp input from outside, and outputs an image signal Source_RGB. The common electrode drive circuit 36 supplies a drive signal to the common electrode COM based on the common potential VCOM.

The video signal Vdisp and a first power supply including a first positive power supply of a voltage value VSP and a first negative power supply of a voltage value VSN are input to the driver IC 3 from outside. The video processing circuit 32, the panel control signal generation circuit 35, and the common electrode drive circuit 36 are circuits operated when the power of the first power supply (first positive power supply and first negative power supply) is supplied. For example, the voltage value VSP of the first positive power supply is +5.5 [V]. For example, the voltage value VSN of the first negative power supply is −5.5 [V].

The power supply generation circuit 31 is a circuit that generates a second power supply (second positive power supply and second negative power supply) and a third power supply (third positive power supply and third negative power supply), by boosting the voltage of the first power supply (first positive power supply and first negative power supply). For example, the second positive power supply and the third positive power supply are obtained by boosting the voltage of the first positive power supply in the positive direction. For example, the second negative power supply and the third negative power supply are obtained by boosting the voltage of the first negative power supply in the negative direction. In the present embodiment, the voltage value of the second positive power supply is represented by VGHO1, and the voltage value of the second negative power supply is represented by VGLO1. The voltage value of the third positive power supply is represented by VGHO2, and the voltage value of the third negative power supply is represented by VGLO2.

Figure 4:
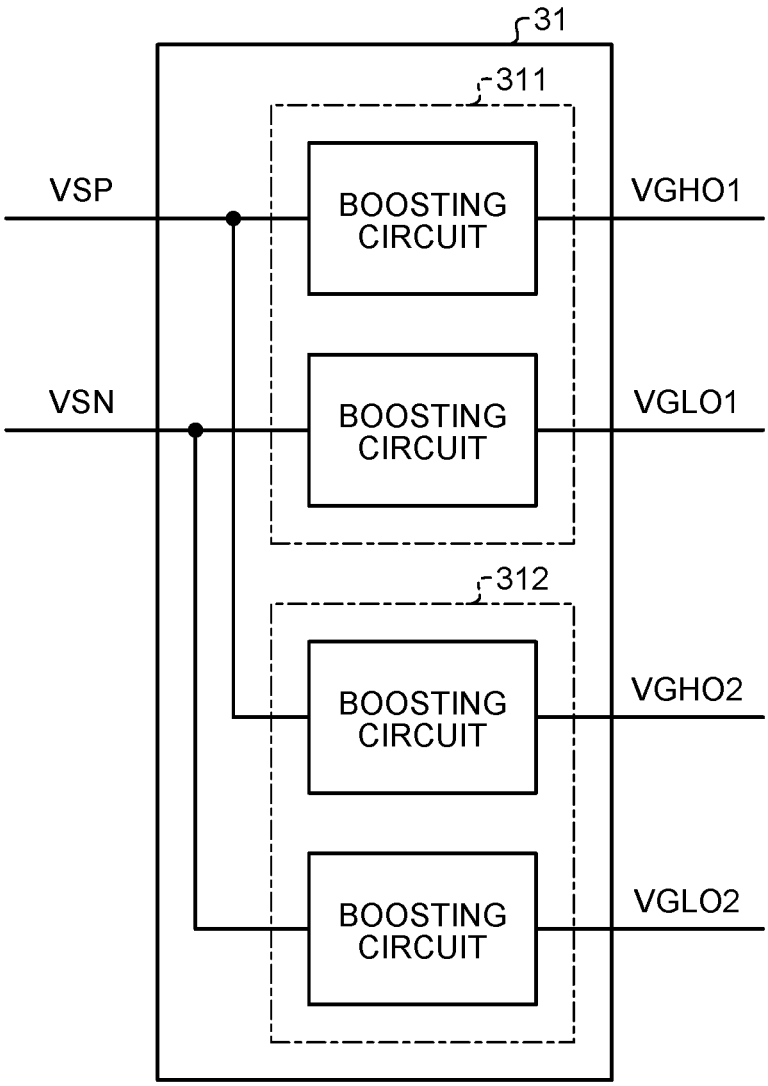
FIG. 4 is a diagram illustrating an example of a block configuration of a power supply generation circuit.

FIG. 4 is a diagram illustrating an example of a block configuration of a power supply generation circuit. As illustrated in FIG. 4, in the present embodiment, the second positive power supply (voltage value VGHO1) and the second negative power supply (voltage value VGLO1) are generated by a first boosting circuit 311. The third positive power supply (voltage value VGHO2) and the third negative power supply (voltage value VGLO2) are generated by a second boosting circuit 312. For example, each of the boosting circuits may be configured by a charge pump circuit and the like.

In the present embodiment, the voltage value VGHO1 of the second positive power supply and the voltage value VGHO2 of the third positive power supply may be the same or may be different from each other. In the following description, the magnitude relation of the voltage value VSP of the first positive power supply, the voltage value VGHO1 of the second positive power supply, and the voltage value VGHO2 of the third positive power supply is VSP<VGHO1<VGHO2.

In the present embodiment, the voltage value VGLO1 of the second negative power supply and the voltage value VGLO2 of the third negative power supply may be the same or may be different from each other. In the following description, the magnitude relation of the voltage value VSN of the first negative power supply, the voltage value VGLO1 of the second negative power supply, and the voltage value VGLO2 of the third negative power supply is VSN<VGLO2<VGLO1.

The power of the second power supply (second positive power supply and second negative power supply) and the third power supply (third positive power supply and third negative power supply) is supplied to the panel control signal generation circuit 35. More specifically, the power of the second power supply (second positive power supply and second negative power supply) is supplied to a first control signal output circuit 351 (will be described below) of the panel control signal generation circuit 35. The power of the second power supply (second positive power supply and second negative power supply) is output as the power supply for the gate driver 22. The power of the third power supply (third positive power supply and third negative power supply) is supplied to a second control signal output circuit 352 (will be described below) of the panel control signal generation circuit 35.

The timing control circuit 33 is a circuit that generates the first control signals (start pulse signal SP and shift clock pulse signal SCK) supplied to the gate driver 22.

The timing control circuit 33 is a circuit that generates the second control signals (signal selection switch control signals ASW and XASW) supplied to the signal selection circuit 23.

Figure 5:
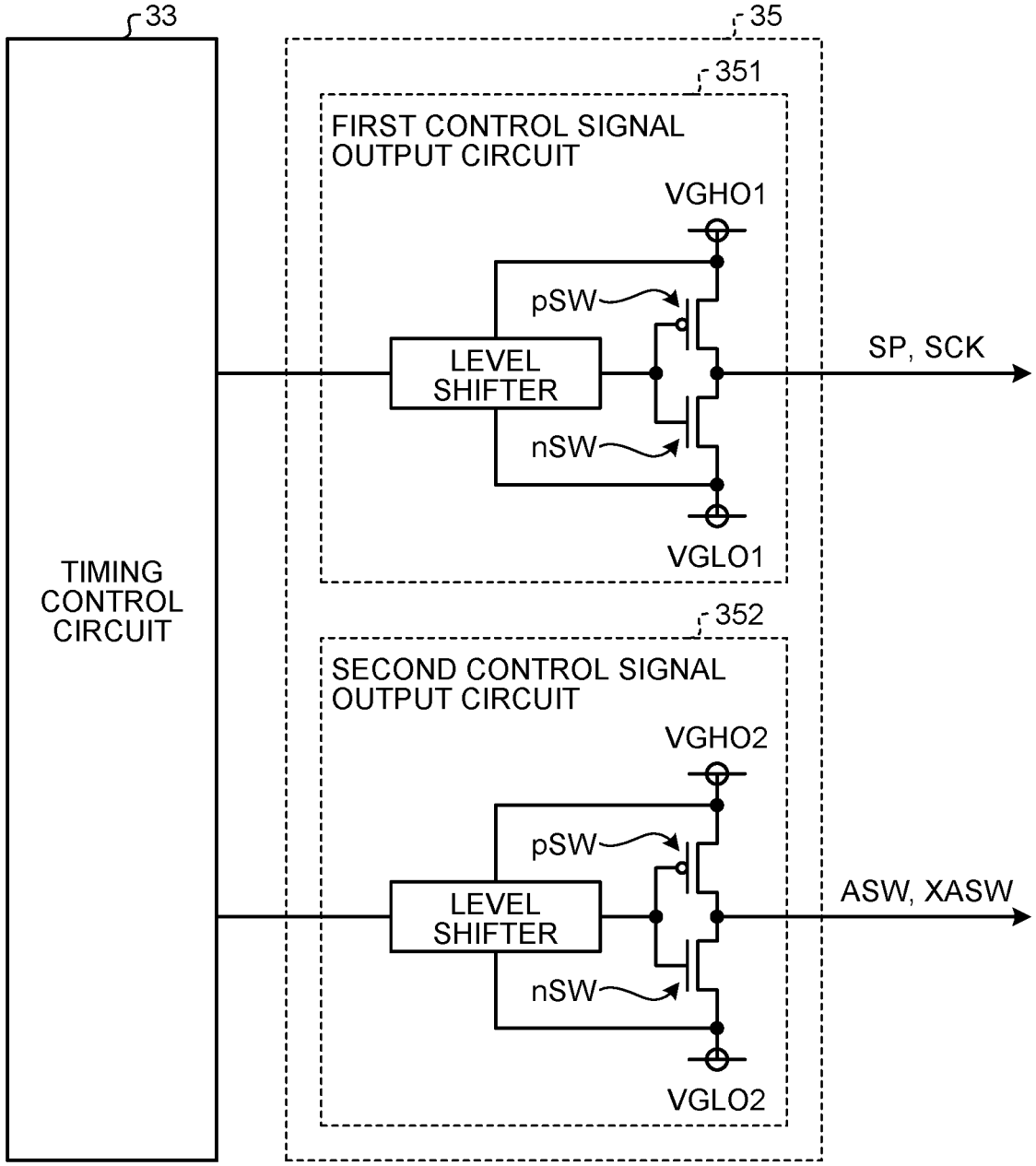
FIG. 5 is a diagram illustrating an example of a block configuration of a panel control signal generation circuit.

FIG. 5 is a diagram illustrating an example of a block configuration of a panel control signal generation circuit. As illustrated in FIG. 5, the panel control signal generation circuit 35 includes the first control signal output circuit 351 and the second control signal output circuit 352. The first control signal output circuit 351 is provided corresponding to the start pulse signal SP and the shift clock pulse signal SCK. A plurality of the second control signal output circuits 352 are provided corresponding to the signal selection switch control signals ASW and XASW.

The first control signal output circuit 351 is a circuit to which the power of the second power supply (second positive power supply (voltage value VGHO1) and second negative power supply (voltage value VGLO1)) is supplied, and that converts the first control signals (start pulse signal SP and shift clock pulse signal SCK) generated by the timing control circuit 33 to the level of the second power supply (second positive power supply (voltage value VGHO1) and second negative power supply (voltage value VGLO1)) and outputs the converted signals.

The second control signal output circuit 352 is a circuit to which the power of the third power supply (third positive power supply (voltage value VGHO2) and third negative power supply (voltage value VGLO2)) is supplied, and that converts the second control signals (signal selection switch control signals ASW and XASW) generated by the timing control circuit 33 to the level of the third power supply (third positive power supply (voltage value VGHO2) and third negative power supply (voltage value VGLO2)) and outputs the converted signals.

For example, as illustrated in FIG. 5, the first control signal output circuit 351 may include a level shifter and a circuit in which an n-type switch nSW and a p-type switch pSW are coupled in series between the second positive power supply (voltage value VGHO1) and the second negative power supply (voltage value VGLO1).

For example, as illustrated in FIG. 5, the second control signal output circuit 352 may include a level shifter and a circuit in which an n-type switch nSW and a p-type switch pSW are coupled in series between the third positive power supply (voltage value VGHO2) and the third negative power supply (voltage value VGLO2).

In FIG. 5, the n-type switch nSW and the p-type switch pSW are metal-oxide-semiconductor field-effect transistors (MOSFETs). In other words, the n-type switch nSW is what is called an nMOS, and the p-type switch pSW is what is called a pMOS.

The configurations of the first control signal output circuit 351 and the second control signal output circuit 352 illustrated in FIG. 5 are merely examples, and the configurations of the first control signal output circuit 351 and the second control signal output circuit 352 are not limited thereto.

Figure 6:
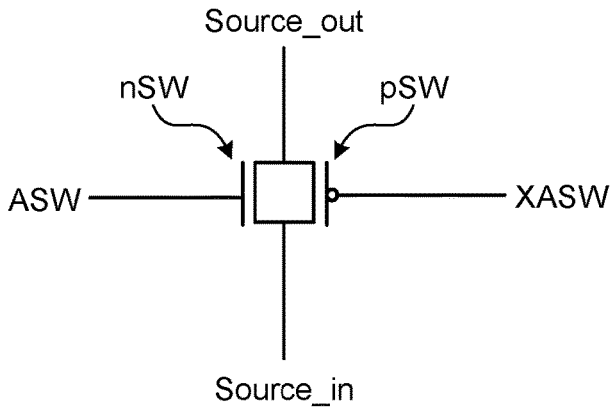
FIG. 6 is a schematic diagram illustrating a basic configuration of a switch circuit provided in a signal selection circuit.
Figure 7:
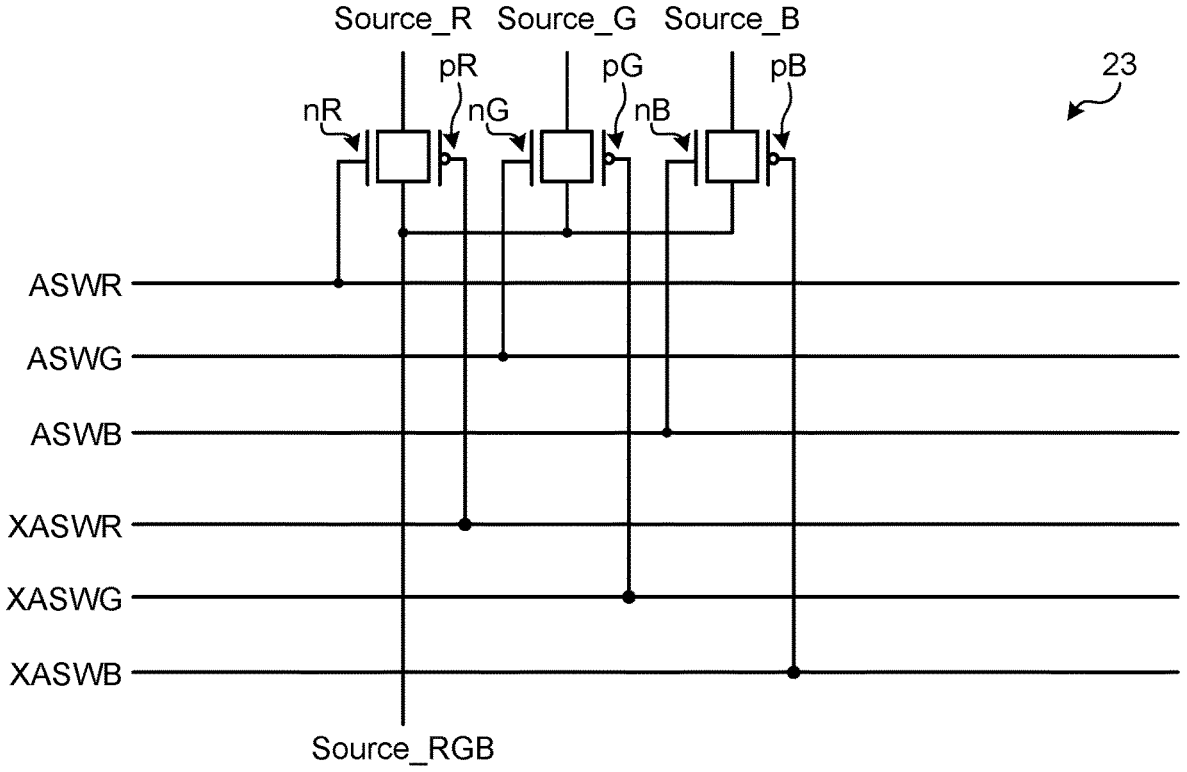
FIG. 7 is a schematic circuit diagram illustrating an example of a signal selection circuit according to the first embodiment.

FIG. 6 is a schematic diagram illustrating a basic configuration of a switch circuit provided in a signal selection circuit. FIG. 7 is a schematic circuit diagram illustrating an example of a signal selection circuit according to the first embodiment.

The switch circuit illustrated in FIG. 6 includes the n-type switch nSW and the p-type switch pSW. The n-type switch nSW is a switch element that opens when a positive value is applied, and the operation of which is controlled so that the n-type switch nSW is opened mainly when a negative signal flows through the path. The p-type switch pSW is a switch element that opens when a negative value is applied, and the operation of which is controlled so that the p-type switch pSW is opened mainly when a positive signal flows through the path. More specifically, the n-type switch nSW is what is called an nMOS, and the p-type switch pSW is what is called a pMOS.

As illustrated in FIG. 7, for example, the signal selection circuit 23 includes the switch circuit in the mode illustrated in FIG. 6 as much as the number of the sub-pixels Vpix forming one pixel Pix. By suitably controlling the switch circuits, the signal selection circuit 23 separates the pixel signals Source_R, G, and B that are time-division multiplexed to the image signal Source_RGB.

Figure 8:
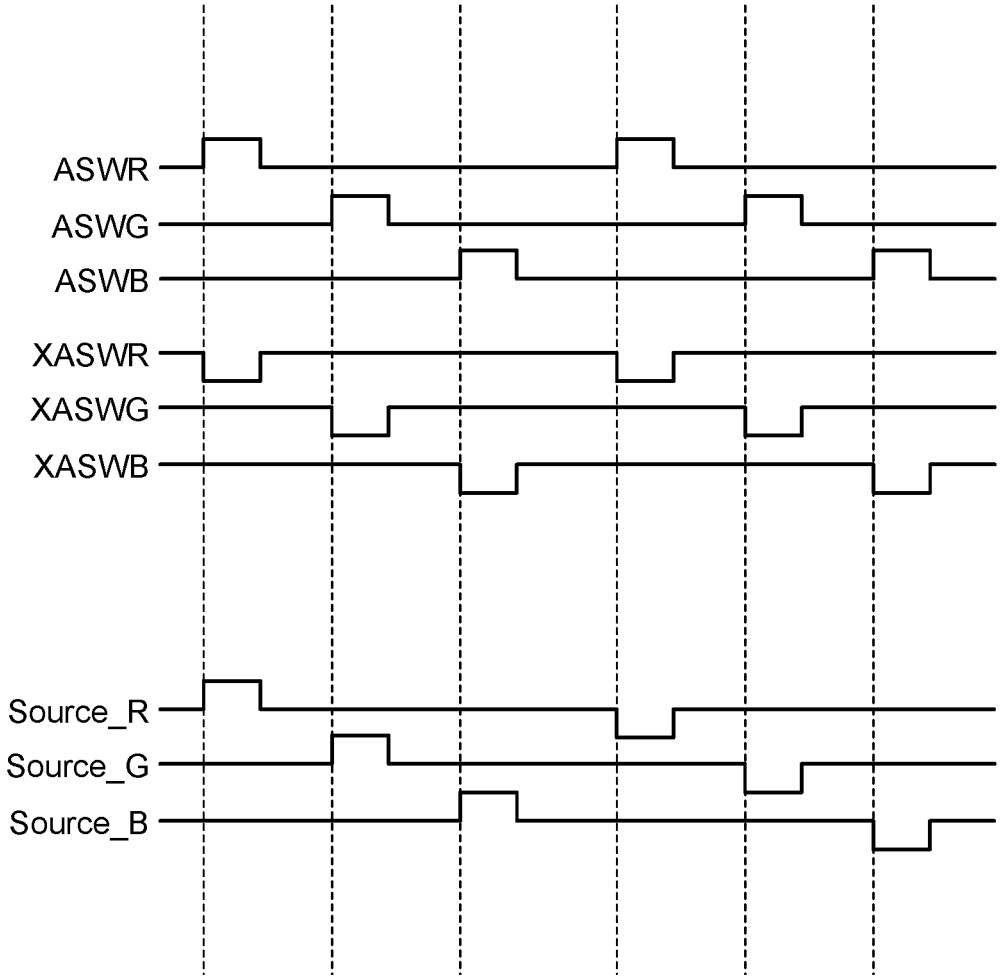
FIG. 8 is a timing chart illustrating a relation between each pixel signal and a signal selection switch control signal.

More specifically, the timing control circuit 33 generates signal selection switch control signals ASWR, ASWG, ASWB, XASWR, XASWG, and XASWB illustrated in FIG. 7. FIG. 8 is a timing chart illustrating a relation between each pixel signal and a signal selection switch control signal.

FIG. 8 illustrates an example using a column inversion driving method. Consequently, the polarity of the pixel signals Source_R, G, and B is inverted column by column (one pixel column).

As illustrated in FIG. 8, each switch circuit is controlled to be turned ON, at the timing when each switch circuit is synchronized with each of the pixel signals Source_R, G, and B corresponding to the sub-pixels Vpix of red (R), green (G), and blue (B).

Consequently, it is possible to separate the pixel signals Source_R, G, and B that are time-division multiplexed to the image signal Source_RGB.

In FIG. 8, the pixel signals Source_R, G, and B are output in the order of red (R), green (G), and blue (B). However, the output order of the pixel signals corresponding to the color of the sub-pixel Vpix is optional, and may be changed as appropriate.

Figure 9:
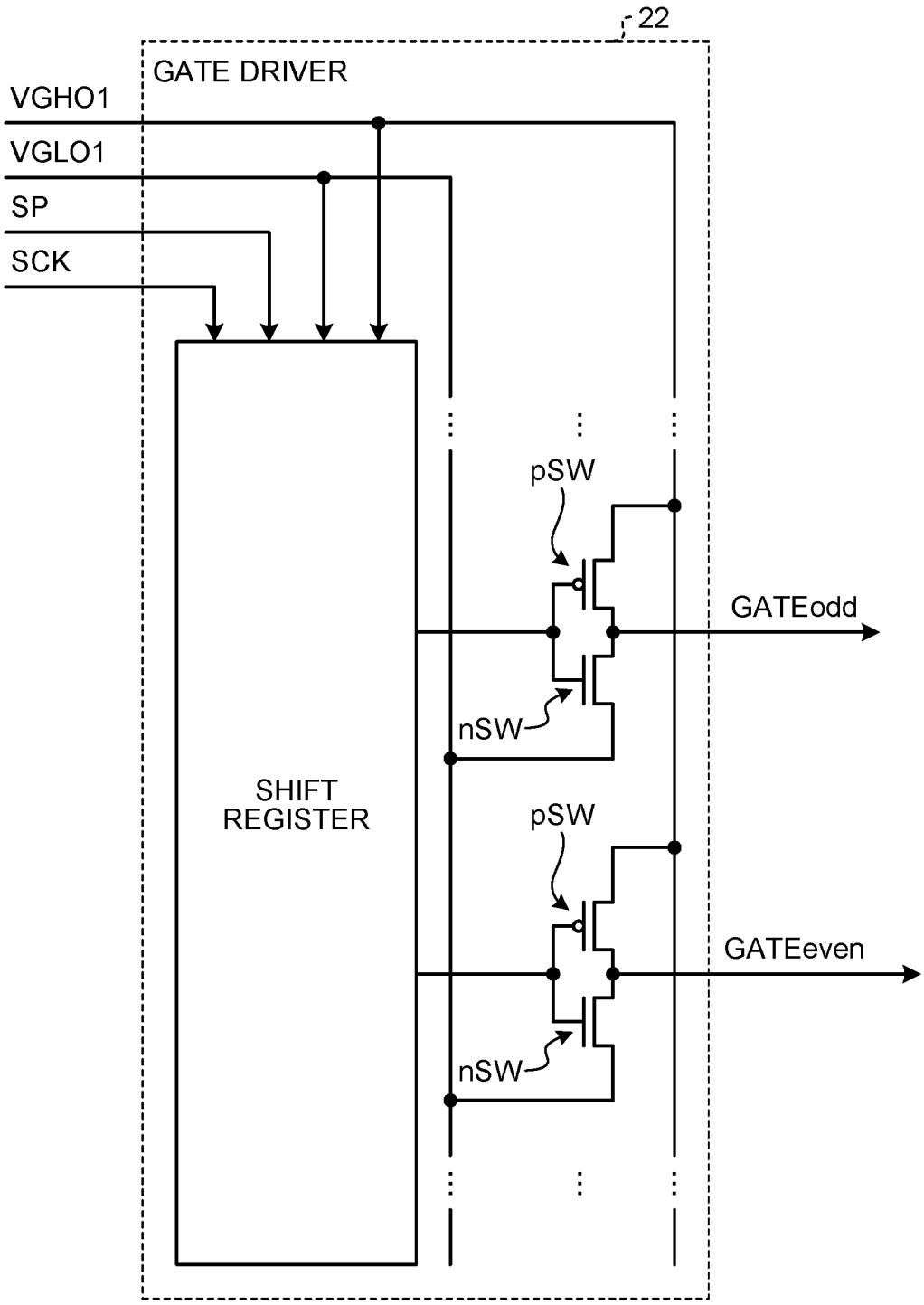
FIG. 9 is a diagram illustrating an example of a block configuration of a gate driver.

FIG. 9 is a diagram illustrating an example of a block configuration of a gate driver. For example, as illustrated in FIG. 8, the gate driver 22 includes a shift register and an output circuit in which the n-type switch nSW and the p-type switch pSW are coupled in series between the second positive power supply (voltage value VGHO1) and the second negative power supply (voltage value VGLO1). The n-type switch nSW is what is called an nMOS and the p-type switch pSW is what is called a pMOS. However, the configuration of the output circuit is not limited thereto.

The second power supply (second positive power supply of the voltage value VGO1 and second negative power supply of the voltage value VGLO1) is supplied to the shift register. The shift register is a circuit that generates scanning signals GATE (n) and GATE (n+1) sequentially supplied to the scanning lines 24, on the basis of the first control signals (start pulse signal SP and shift clock pulse signal SCK) output from the first control signal output circuit 351.

The scanning signal GATE (n) is output to the scanning line 24 of the n-th row (n is a natural number), via the output circuit. The scanning signal GATE (n+1) is output to the scanning line 24 of the (n+1)th row, via the output circuit. In FIG. 9, one circuit is illustrated for each of the scanning signals GATE (n) and GATE (n+1).

Figure 10:
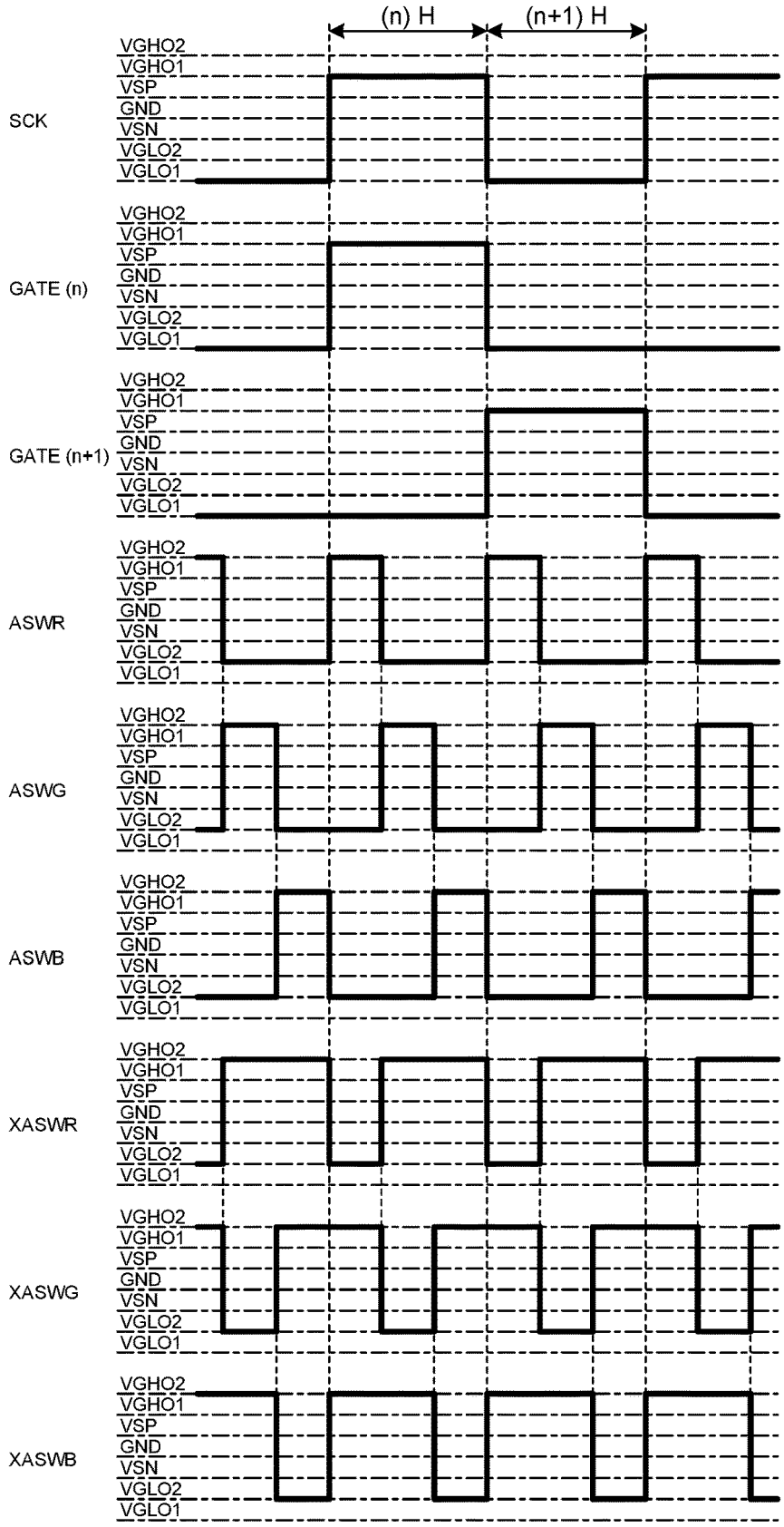
FIG. 10 is a timing chart illustrating an example of voltage transition of each unit in the display device according to the first embodiment.

FIG. 10 is a timing chart illustrating an example of voltage transition of each unit in the display device according to the first embodiment. A period (n)H illustrated in FIG. 10 indicates a period during which a gate signal is applied to the gate of the TFT element Tr of the sub-pixel Vpix in the n-th row by the scanning signal GATE (n). A period (n+1)H indicates a period subsequent to the period (n)H, and during which a gate signal is applied to the gate of the TFT element Tr of the sub-pixel Vpix in the n+1 row by the scanning signal GATE (n+1).

In the present embodiment, the first control signals (start pulse signal SP and shift clock pulse signal SCK) generated by the timing control circuit 33 are output to the gate driver 22, via the first control signal output circuit 351 to which the power of the second power supply (second positive power supply (voltage value VGHO1) and second negative power supply (voltage value VGLO1)) is supplied. The gate driver 22 is operated when the power of the second power supply (second positive power supply (voltage value VGHO1) and second negative power supply (voltage value VGLO1)) is supplied. As a result, as illustrated in FIG. 10, in the shift clock pulse signal SCK that is the first control signal, and the scanning signals GATE (n) and GATE (n+1) generated on the basis of the start pulse signal SP and the shift clock pulse signal SCK that are the first control signals, an "L" period and an "H" period are switched between the voltage value VGHO1 of the second positive power supply and the voltage value VGLO1 of the second negative power supply that are the second power supply.

In the present embodiment, the second control signals (signal selection switch control signals ASWR, ASWG, ASWB, XASWR, XASWG, and XASWB) generated by the timing control circuit 33 are output to the signal selection circuit 23, via the second control signal output circuit 352 to which the power of the third power supply (third positive power supply (voltage value VGHO2) and third negative power supply (voltage value VGLO2)) is supplied. As a result, as illustrated in FIG. 10, in the signal selection switch control signals ASWR, ASWG, ASWB, XASWR, XASWG, and XASWB that are the second control signals, the "L" period and the "H" period are switched between the voltage value VGHO2 of the third positive power supply and the voltage value VGLO2 of the third negative power supply that are the third power supply.

Due to the switching operations of the signals illustrated in FIG. 10, switching noise may be generated in the power supply line. In particular, the frequencies of the second control signals (signal selection switch control signals ASWR, ASWG, ASWB, XASWR, XASWG, and XASWB) supplied to the signal selection circuit 23 are increased with an increase in the number of time-divisions of the RGB image signal Source_RGB, when the resolution of the display panel 2 is increased or the frame of the display panel 2 is reduced. In this case, it may be difficult to provide a slew rate of the second control signal and reduce noise.

For example, when the first control signal output circuit 351, the gate driver 22, and the second control signal output circuit 352 are driven by the same power supply, the switching noise generated by the switching operation of the second control signals (signal selection switch control signals ASWR, ASWG, ASWB, XASWR, XASWG, and XASWB) is propagated to the gate driver 22 via the power supply line. The switching noise propagated to the gate driver 22 is emitted from all the scanning lines 24 in the display area 21, and causes an increase in the radiation noise.

In the present embodiment, the power supplies that supply power to the first control signal output circuit 351 and the gate driver 22, and to the second control signal output circuit 352 are different. More specifically, the second power supply (second positive power supply (voltage value VGHO1) and second negative power supply (voltage value VGLO1)) that supplies power to the first control signal output circuit 351 and the gate driver 22, and the third power supply (third positive power supply (voltage value VGHO2) and third negative power supply (voltage value VGLO2)) that supplies power to the second control signal output circuit 352 are the power supplies of separate systems via a boosting circuit of the power supply generation circuit 31. Consequently, it is possible to suppress the switching noise generated by the switching operation of the second control signals (signal selection switch control signals ASWR, ASWG, ASWB, XASWR, XASWG, and XASWB) from propagating to the gate driver 22, and suppress radiation noise.

In the first embodiment described above, an example in which the second power supply (second positive power supply and second negative power supply) and the third power supply (third positive power supply and third negative power supply) are generated, by boosting the voltage of the first power supply (first positive power supply and first negative power supply) has been described. However, it is not limited thereto. At least one of the power supply that supplies power to the first control signal output circuit 351 and the gate driver 22, and the power supply that supplies power to the second control signal output circuit 352 may be the power supply in which the voltage of the first power supply (first positive power supply and first negative power supply) is boosted by the boosting circuit.

In the first embodiment described above, an example in which each of the first power supply, the second power supply, and the third power supply includes the positive power supply having a positive voltage value and the negative power supply having a negative voltage value has been described. However, it is not limited thereto. For example, each of the first power supply, the second power supply, and the third power supply may be a single power supply of the positive power supply or the negative power supply.

As described above, the display device 1 according to the embodiment includes the pixels (sub-pixels Vpix) arranged in a matrix (row-column configuration) in the display area 21, the scanning line 24 that is coupled to the sub-pixels Vpix aligned in the row direction in the display area 21 and to which the scanning signal is supplied, the signal line 25 that is coupled to the sub-pixels Vpix aligned in the column direction in the display area 21 and to which the pixel signal is supplied, and the gate driver 22 that supplies the scanning signal to the scanning line 24. The display device 1 also includes the signal selection circuit 23 that separates the pixel signal time-division multiplexed to the image signal, the first control signal output circuit 351 that outputs the first control signals (start pulse signal SP and shift clock pulse signal SCK) supplied to the gate driver 22, and the second control signal output circuit 352 that outputs the second control signals (signal selection switch control signals ASW and XASW) supplied to the signal selection circuit 23. At least one of the gate driver 22, the first control signal output circuit 351, and the second control signal output circuits 352 performs a display operation, when power of the first power supply (first positive power supply and first negative power supply) the voltage of which is boosted by the boosting circuit is supplied thereto.

With the configuration described above, it is possible to suppress the propagation of the switching noise generated by the switching operation of the second control signals (signal selection switch control signals ASW and XASW) to the gate driver 22, and suppress radiation noise.

With the present embodiment, it is possible to provide the display device 1 capable of suppressing radiation noise.

Second Embodiment

Figure 11:
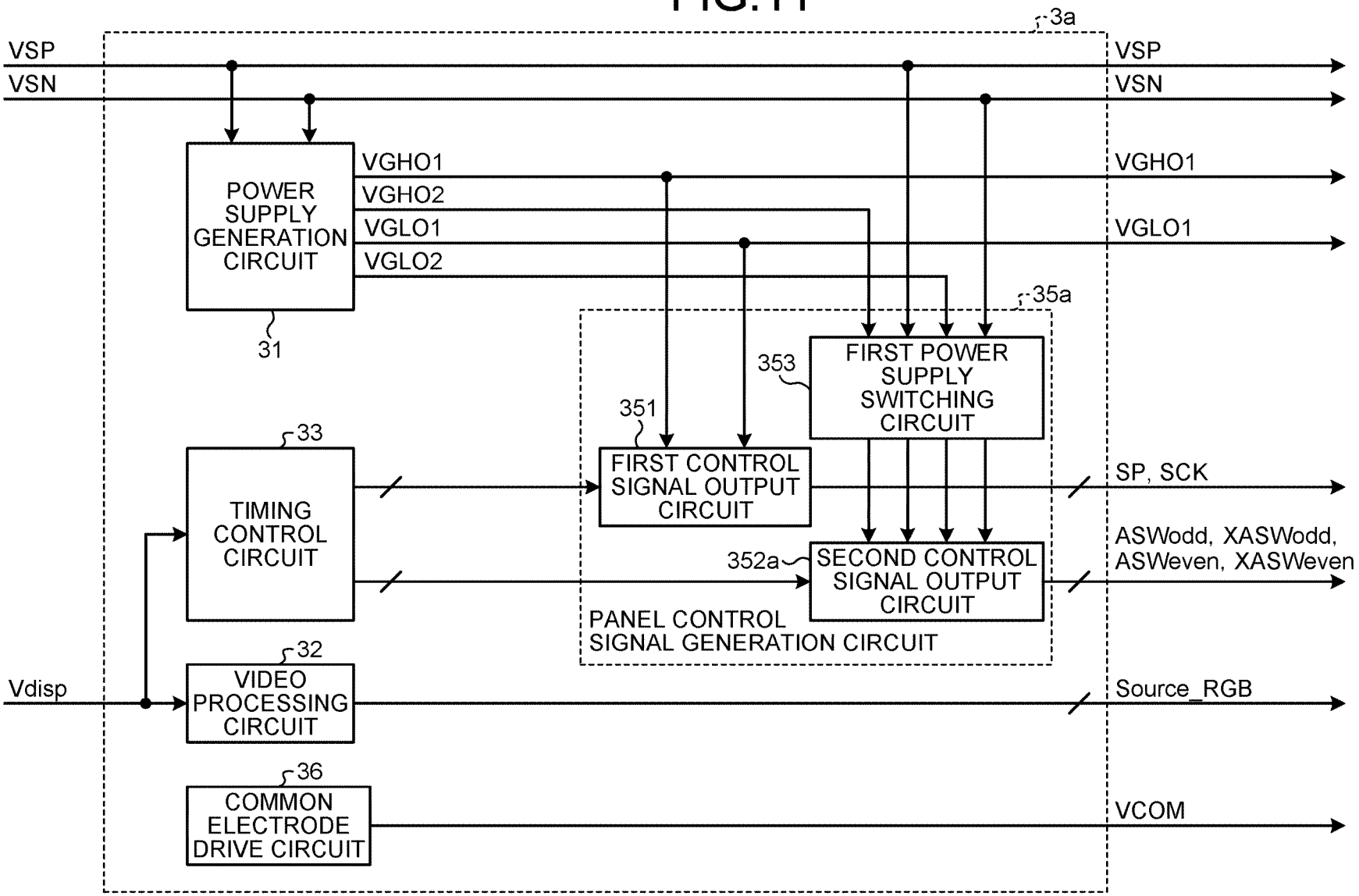
FIG. 11 is a diagram illustrating an example of an internal block configuration of a driver IC of a display device according to a second embodiment.
Figure 12:
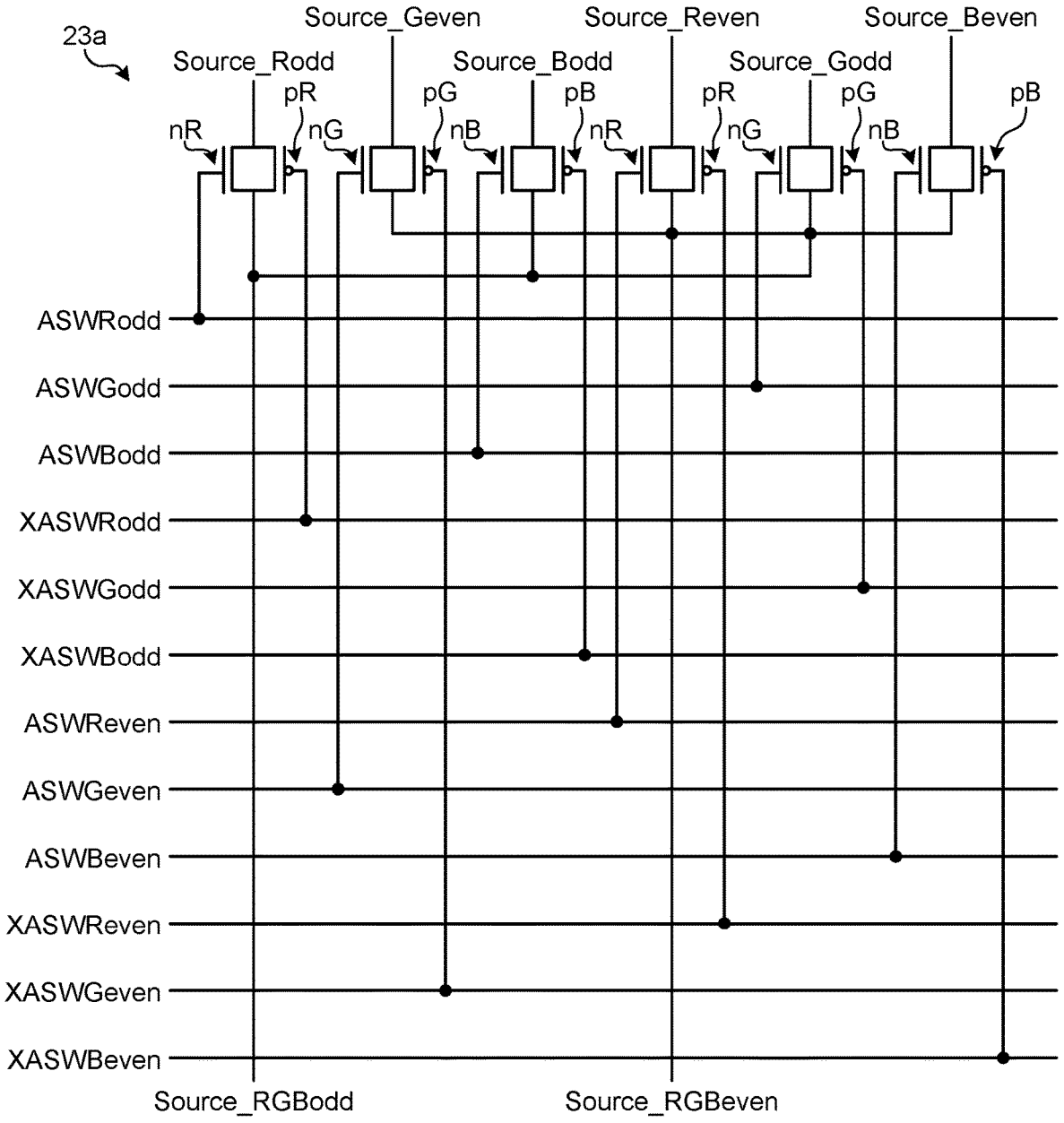
FIG. 12 is a schematic circuit diagram illustrating an example of a signal selection circuit according to the second embodiment.
Figure 13:
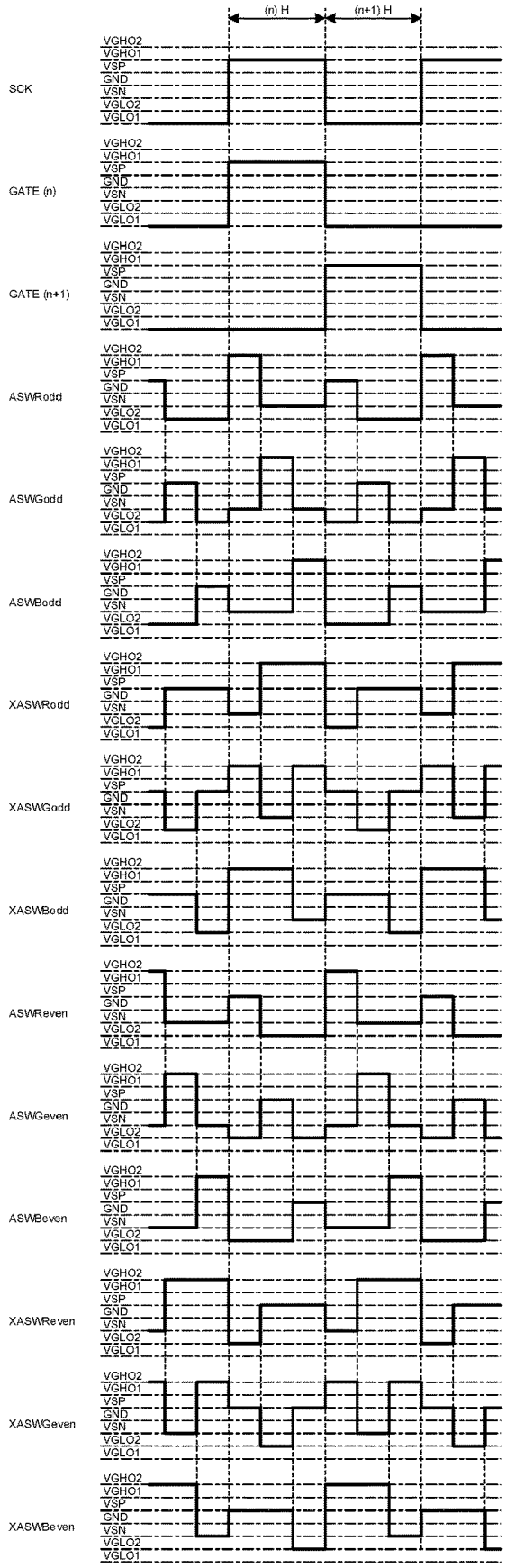
FIG. 13 is a timing chart illustrating an example of voltage transition of each unit in the display device according to the second embodiment.

FIG. 11 is a diagram illustrating an example of an internal block configuration of a driver IC of a display device according to a second embodiment. FIG. 12 is a schematic circuit diagram illustrating an example of a signal selection circuit according to the second embodiment. FIG. 13 is a timing chart illustrating an example of voltage transition of each unit in the display device according to the second embodiment. The same reference numerals denote the components having the same functions as those in the first embodiment described above, and the description thereof will be omitted. In the display device of the second embodiment, points different from those in the first embodiment will be mainly described.

In the second embodiment, similar to the first embodiment, the column inversion driving method is used as the driving method of the pixels Pix provided in the display area 21 of the display device 1. As the second control signals, a driver IC 3*a* outputs signal selection switch control signals ASWodd and XASWodd for the sub-pixels Vpix in the odd columns, and signal selection switch control signals ASWeven and XASWeven for the sub-pixels Vpix in the even columns.

In the present embodiment, when the pixel signal has a positive polarity, instead of the power of the third negative power supply (voltage value VGLO2), the power of the first negative power supply (voltage value VSN) is supplied, as the power supply for the signal selection switch control signals ASWodd, XASWodd, ASWeven, and XASWeven that are the second control signals. When the pixel signal has a negative polarity, instead of the power of the third positive power supply (voltage value VGHO2), the power of the first positive power supply (voltage value VPN) is supplied, as the power supply for the signal selection switch control signals ASWodd, XASWodd, ASWeven, and XASWeven that are the second control signals. Consequently, it is possible to reduce the amplitude value of the signal selection switch control signals ASWodd, XASWodd, ASWeven, and XASWeven that are the second control signals, and reduce the switching noise generated by the switching operation of the second control signals (signal selection switch control signals ASWodd, XASWodd, ASWeven, and XASWeven).

A panel control signal generation circuit 35*a* includes a first power supply switching circuit 353 that switches the power between the first power supply (first positive power supply (voltage value VSP) and first negative power supply (voltage value VSN)) and the third power supply (third positive power supply (voltage value VGHO2) and third negative power supply (voltage value VGLO2)), and that supplies the power to a second control signal output circuit 352*a*.

During the period (n)H, the first power supply switching circuit 353 supplies the power of the third positive power supply (voltage value VGHO2) and the power of the first negative power supply (voltage value VSN) to the second control signal output circuit 352*a*, as the power supply for the signal selection switch control signals ASWodd and XASWodd. Consequently, as illustrated in FIG. 13, during the period (n)H, in signal selection switch control signals ASWoddR, ASWoddG, ASWoddB, XASWoddR, XASWoddG, and XASWoddB that are the second control signals, the "L" period and the "H" period are switched between the voltage value VGHO2 of the third positive power supply that is the third power supply, and the voltage value VSN of the first negative power supply that is the first power supply.

During the period (n)H, the first power supply switching circuit 353 supplies the power of the first positive power supply (voltage value VSP) and the power of the third negative power supply (voltage value VGLO2) to the second control signal output circuit 352*a*, as the power supply for the signal selection switch control signals ASWeven and XASWeven. Consequently, as illustrated in FIG. 13, during the period (n)H, in the signal selection switch control signals ASWevenR, ASWevenG, ASWevenB, XASWevenR, XASWevenG, and XASWevenB that are the second control signals, the "L" period and the "H" period are switched between the voltage value VSP of the first positive power supply that is the first power supply, and the voltage value VGLO2 of the third negative power supply that is the third power supply.

During the period (n+1)H, the first power supply switching circuit 353 supplies the power of the first positive power supply (voltage value VSP) and power of the third negative power supply (voltage value VGLO2) to the second control signal output circuit 352*a*, as the power supply for the signal selection switch control signals ASWodd and XASWodd. Consequently, as illustrated in FIG. 13, during the period (n+1)H, in the signal selection switch control signals ASWoddR, ASWoddG, ASWoddB, XASWoddR, XASWoddG, and XASWoddB that are the second control signals, the "L" period and the "H" period are switched between the voltage value VSP of the first positive power supply that is the first power supply, and the voltage value VGLO2 of the third negative power supply that is the third power supply.

During the period (n+1)H, the first power supply switching circuit 353 supplies the power of the third positive power supply (voltage value VGHO2) and the power of the first negative power supply (voltage value VSN) to the second control signal output circuit 352*a*, as the power supply for the signal selection switch control signals ASWeven and XASWeven. Consequently, as illustrated in FIG. 13, during the period (n+1)H, in the signal selection switch control signals ASWevenR, ASWevenG, ASWevenB, XASWevenR, XASWevenG, and XASWevenB that are the second control signals, the "L" period and the "H" period are switched between the voltage value VGHO2 of the third positive power supply that is the third power supply, and the voltage value VSN of the first negative power supply that is the first power supply.

Consequently, the switch circuits of a signal selection circuit 23*a* can reduce the amplitude value of the signal selection switch control signals ASWodd, XASWodd, ASWeven, and XASWeven than that of the first embodiment. Consequently, it is possible to reduce the switching noise generated by the switching operation of the second control signals (signal selection switch control signals ASWodd, XASWodd, ASWeven, and XASWeven), and suppress the radiation noise than that of the first embodiment.

With the present embodiment, it is possible to provide the display device 1 capable of suppressing radiation noise.

Third Embodiment

Figure 14:
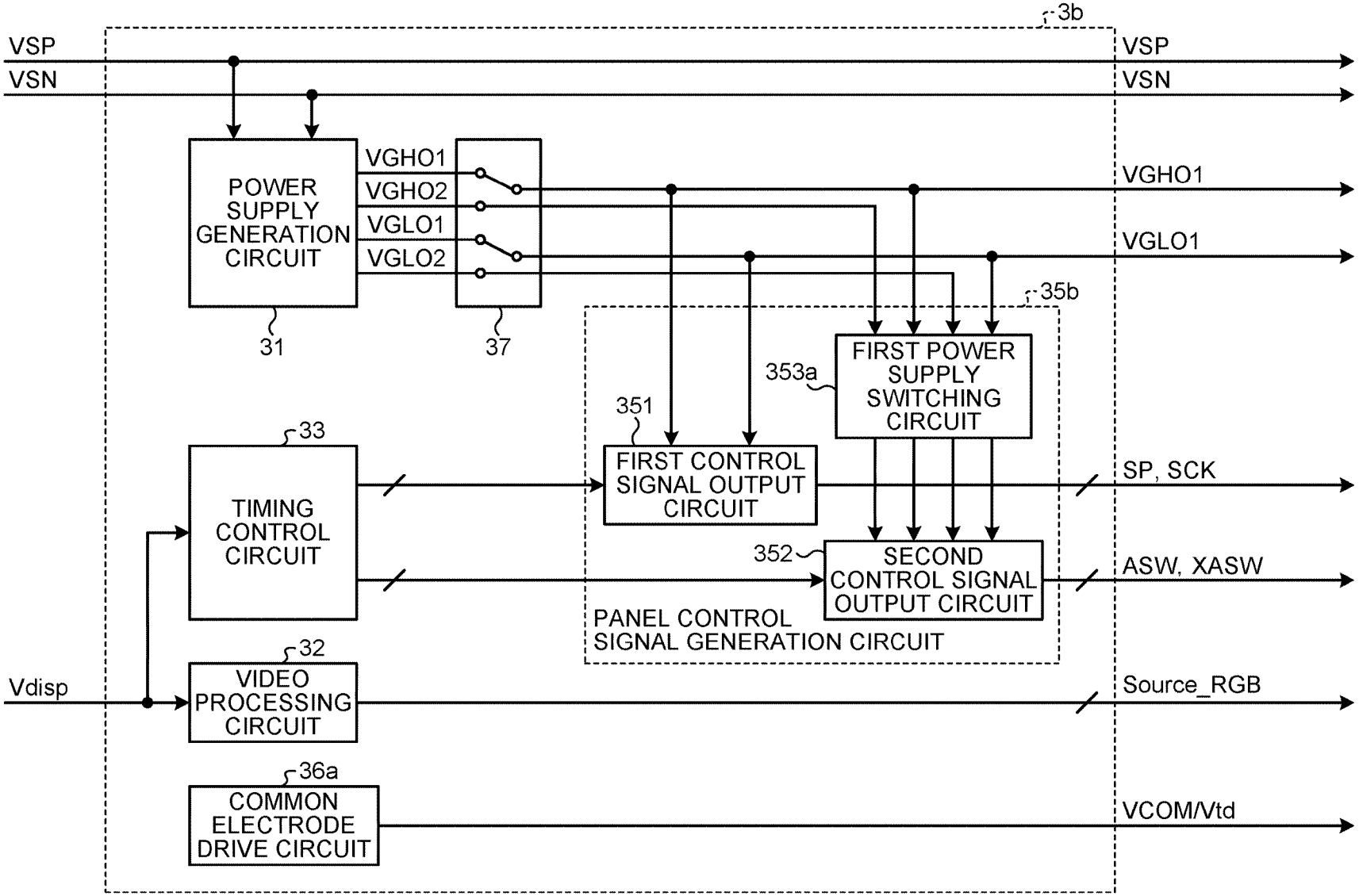
FIG. 14 is a diagram illustrating an example of an internal block configuration of a driver IC of a display device according to a third embodiment and a first operation example.
Figure 15:
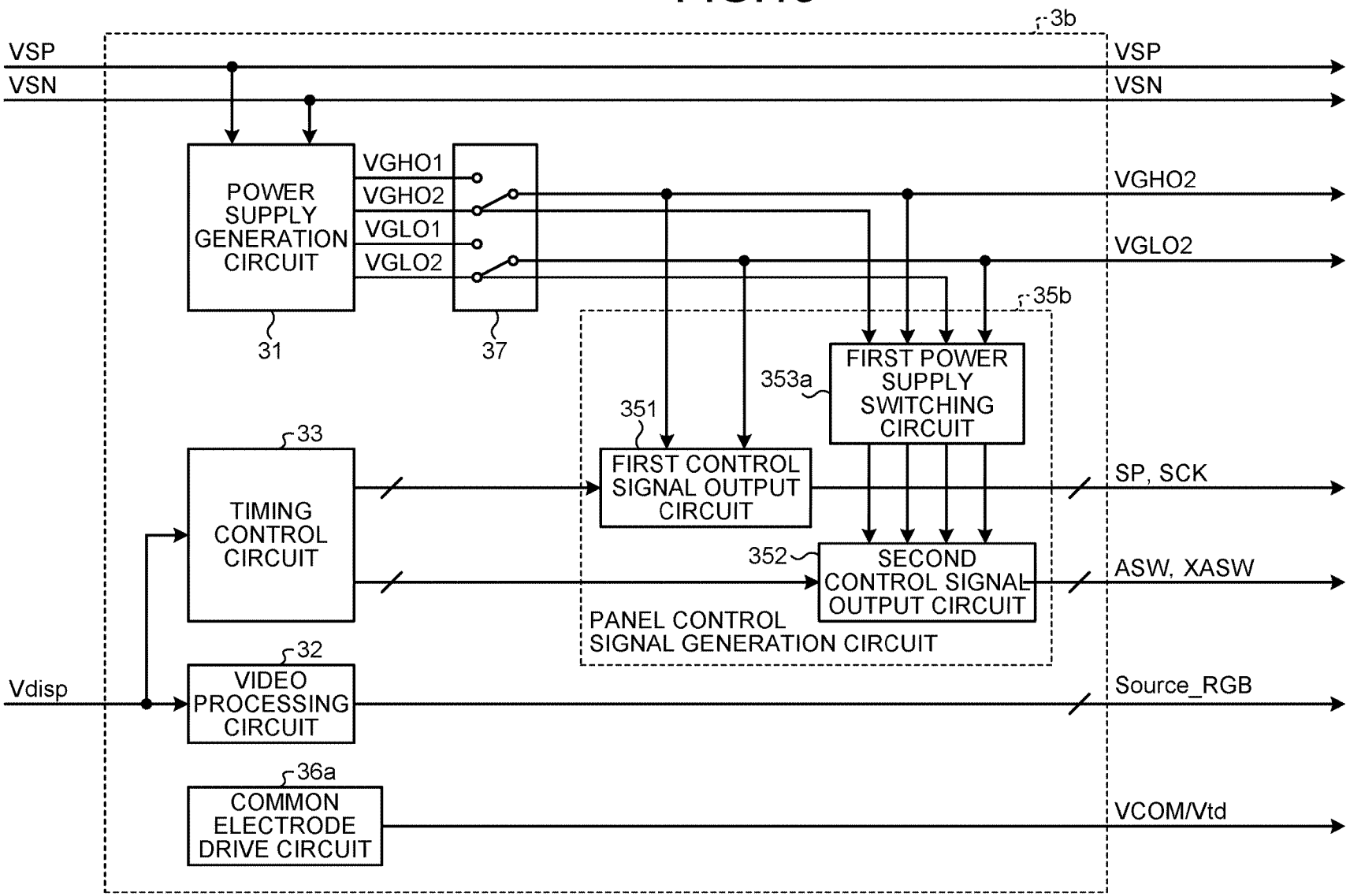
FIG. 15 is a diagram illustrating an example of the internal block configuration of the driver IC of the display device according to the third embodiment and a second operation example.
Figure 16:
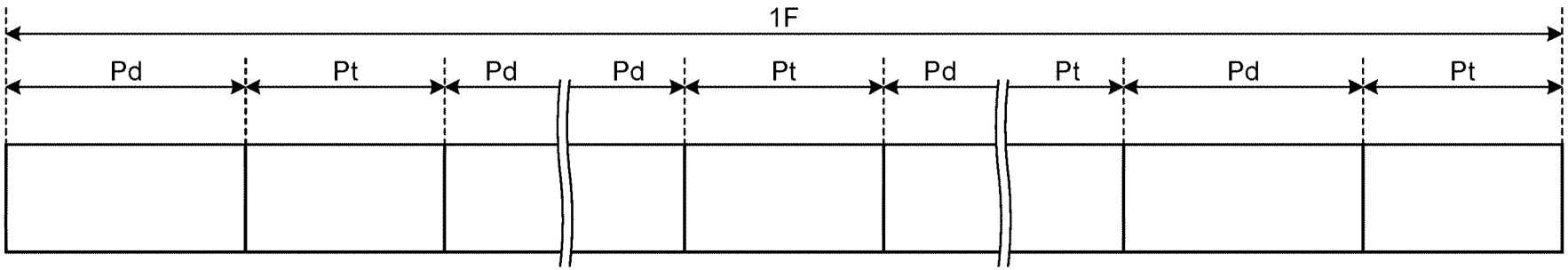
FIG. 16 is a diagram illustrating an example of time division of a display period and a detection period in the display device according to the third embodiment.
Figure 17:
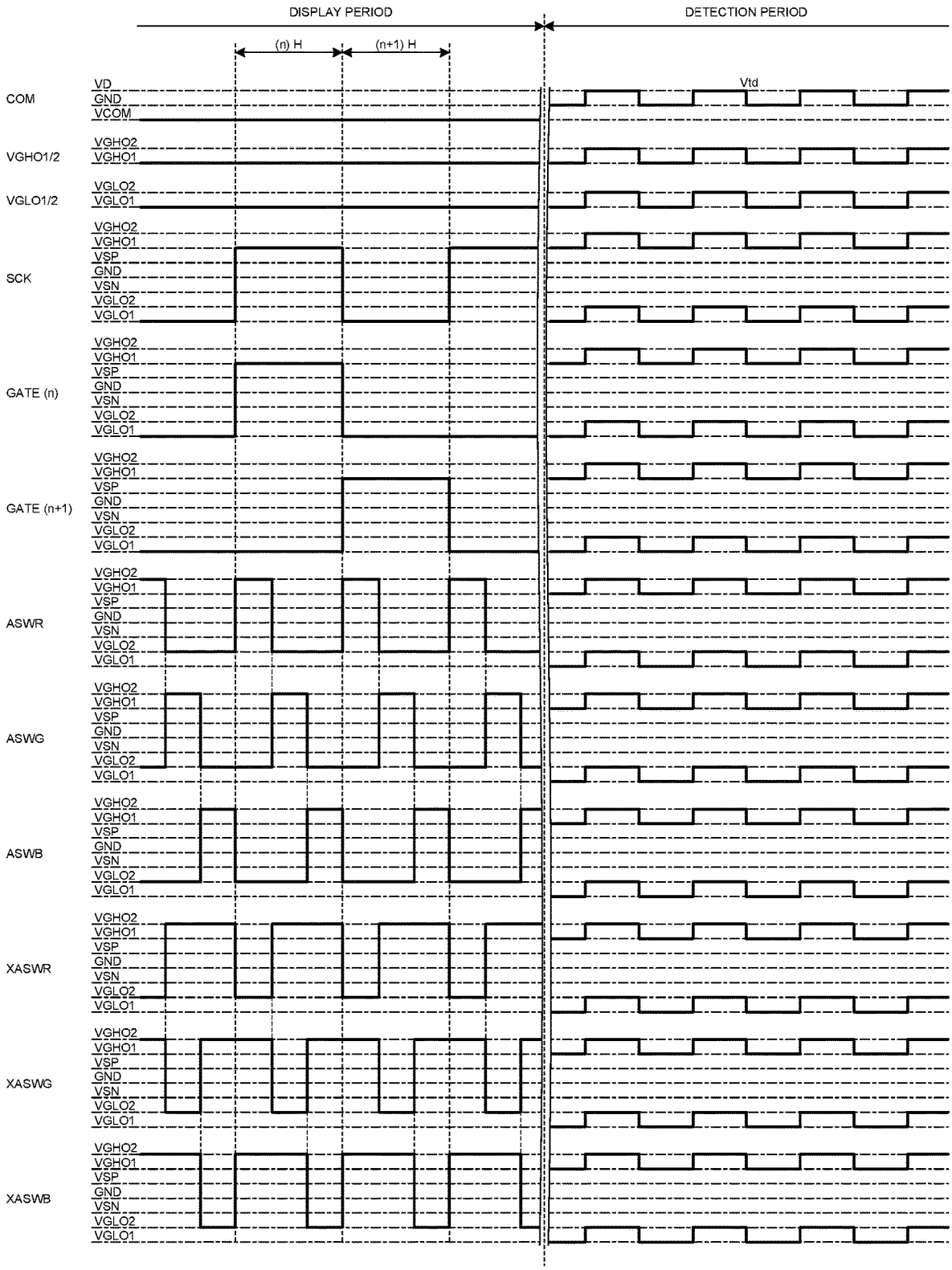
FIG. 17 is a timing chart illustrating an example of voltage transition of each unit in the display device according to the third embodiment.

FIG. 14 is a diagram illustrating an example of an internal block configuration of a driver IC of a display device according to a third embodiment and a first operation example. FIG. 15 is a diagram illustrating an example of the internal block configuration of the driver IC of the display device according to the third embodiment and a second operation example. FIG. 16 is a diagram illustrating an example of time division of a display period and a detection period in the display device according to the third embodiment. FIG. 17 is a timing chart illustrating an example of voltage transition of each unit in the display device according to the third embodiment. The same reference numerals denote the components having the same functions as those in the first and second embodiments described above, and the description thereof will be omitted. In the display device of the third embodiment, points different from those in the first and second embodiments will be mainly described.

In the third embodiment, an operation of the configuration in which a capacitive touch sensor is integrated with the display panel 1 will be described. As an example of a configuration in which the capacitive touch sensor is integrated with the display panel 1, there is a mutual detection method. The mutual detection method detects a touch, by dividing a common electrode used for displaying into a plurality of common electrodes, providing a plurality of detection electrodes opposite to the common electrodes, driving the common electrodes during a touch detection period different from the display period, and detecting the variation of the detection electrodes. As another example of the configuration in which the capacitive touch sensor is integrated with the display panel 1, there is a self-detection method. The self-detection method detects a touch, by dividing a common electrode used for displaying into a plurality of common electrodes, driving the common electrodes during a touch detection period different from the display period, and detecting the variation of own common electrode.

As illustrated in FIG. 16, in the present embodiment, a display period Pd during which the circuit is operated in a display mode and a detection period Pt during which the circuit is operated in a detection mode are alternately executed in a time division manner. In the example illustrated in FIG. 16, one frame period 1F is divided into a plurality of the display periods Pd and a detection period Pt1 is provided between the display periods Pd. However, the mode of the display period Pd and the detection period Pt is not limited thereto.

In the examples illustrated in FIG. 14 and FIG. 15, a common electrode drive circuit 36*a* supplies a drive signal Vtd used for detecting a touch, during the detection period Pt. The drive signal Vtd is a signal that toggles between the GND potential and a peak value VD at each predetermined period. In the present embodiment, the potential difference between the second positive power supply (voltage value VGHO1) and the third positive power supply (voltage value VGHO2), and the potential difference between the second negative power supply (voltage value VGLO1) and the third negative power supply (voltage value VGLO2) are substantially equivalent to the peak value VD of the drive signal Vtd.

As illustrated in FIG. 14 and FIG. 15, a driver IC 3*b* includes a second power supply switching circuit 37 that switches the power between the second power supply (second positive power supply (voltage value VGHO1) and second negative power supply (voltage value VGLO1)), and the third power supply (third positive power supply (voltage value VGHO2) and third negative power supply (voltage value VGLO2)), and that supplies the power to the first control signal output circuit 351 and the gate driver 22.

During the display period Pd, the second power supply switching circuit 37 supplies the power of the second power supply (second positive power supply (voltage value VGHO1) and second negative power supply (voltage value VGLO1)), to the first control signal output circuit 351 and the gate driver 22 (FIG. 14). In this process, a first power supply switching circuit 353*a* of a panel control signal generation circuit 35*b* supplies the power of the third power supply (third positive power supply (voltage value VGHO2) and third negative power supply (voltage value (VGLO2)) to the second control signal output circuit 352. Consequently, during the display period Pd, similar to the first embodiment, the power of the second power supply (second positive power supply (voltage value VGHO1) and second negative power supply (voltage value VGLO1)) is supplied to the first control signal output circuit 351 and the gate driver 22, and the power of the third power supply (third positive power supply (voltage value VGHO2) and third negative power supply (voltage value VGLO2)) is supplied to the second control signal output circuit 352.

During the detection period Pt, the second power supply switching circuit 37 synchronizes with the drive signal Vtd, toggles (switches) power between the second power supply (second positive power supply (voltage value VGHO1) and second negative power supply (VGLO1)), and the third power supply (third positive power supply (voltage value VGHO2) and third negative power supply (voltage value VGLO2)), and supplies the power to the first control signal output circuit 351 and the gate driver 22 (FIG. 14 and FIG. 15).

In this process, the first power supply switching circuit 353*a* of the panel control signal generation circuit 35*b* controls the power so that the power supplied to the first control signal output circuit 351 and the gate driver 22 is also supplied to the second control signal output circuit 352.

Consequently, the shift clock pulse signal SCK that is the first control signal; the scanning signals GATE (n) and GATE (n+1) generated on the basis of the start pulse signal SP and the shift clock pulse signal SCK that are the first control signals; and the signal selection switch control signals ASWR, ASWG, ASWB, XASWR, XASWG, and XASWB that are the second control signals, are signals synchronized with the drive signal Vtd. These signals are one of the signals that toggles between the voltage value VGHO1 of the second positive power supply and the voltage value VGHO2 of the third positive power supply, or the signal that toggles between the voltage value VGLO1 of the second negative power supply and the voltage value VGLO2 of the third negative power supply, according to the timing when the display period Pd is switched to the detection period Pt.

Modification

Figure 18:
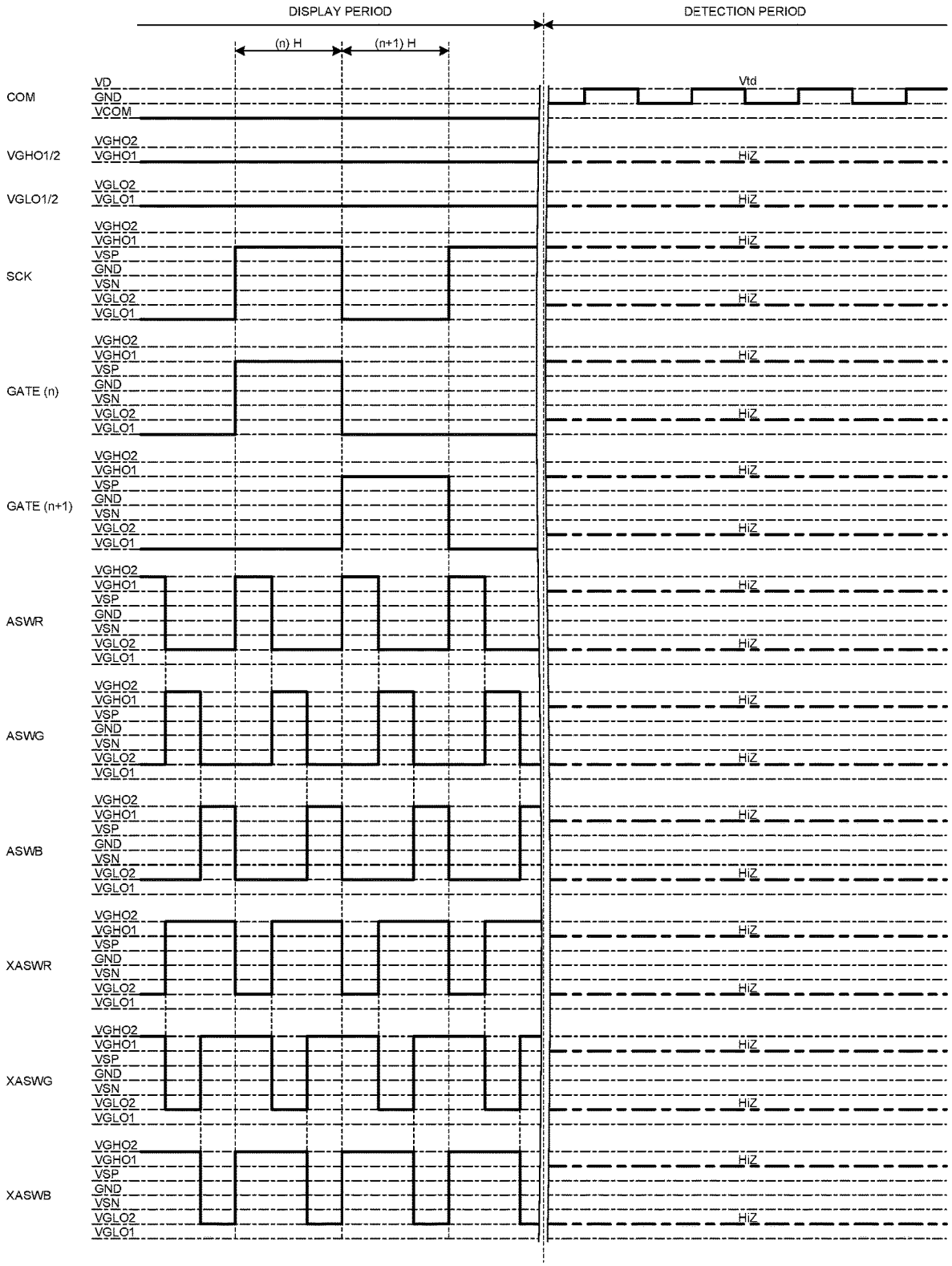
FIG. 18 is a timing chart illustrating an example of voltage transition of each unit in the display device according to a modification of the third embodiment.

FIG. 18 is a timing chart illustrating an example of voltage transition of each unit in the display device according to a modification of the third embodiment. In the example illustrated in FIG. 18, during the detection period Pt, the second power supply switching circuit 37 is controlled to be turned OFF. In other words, neither the power supplied from the second power supply (second positive power supply (voltage value VGHO1) and second negative power supply (voltage value VGLO1)), or the power supplied from the third power supply (third positive power supply (voltage value VGHO2) and third negative power supply (voltage value VGLO2)) is selected. Consequently, the shift clock pulse signal SCK that is the first control signal; the scanning signals GATE (n) and GATE (n+1) generated on the basis of the start pulse signal SP and the shift clock pulse signal SCK that are the first control signals; and the signal selection switch control signals ASWR, ASWG, ASWB, XASWR, XASWG, and XASWB that are the second control signals may be in high impedance HiZ.

Fourth Embodiment

Figure 19:
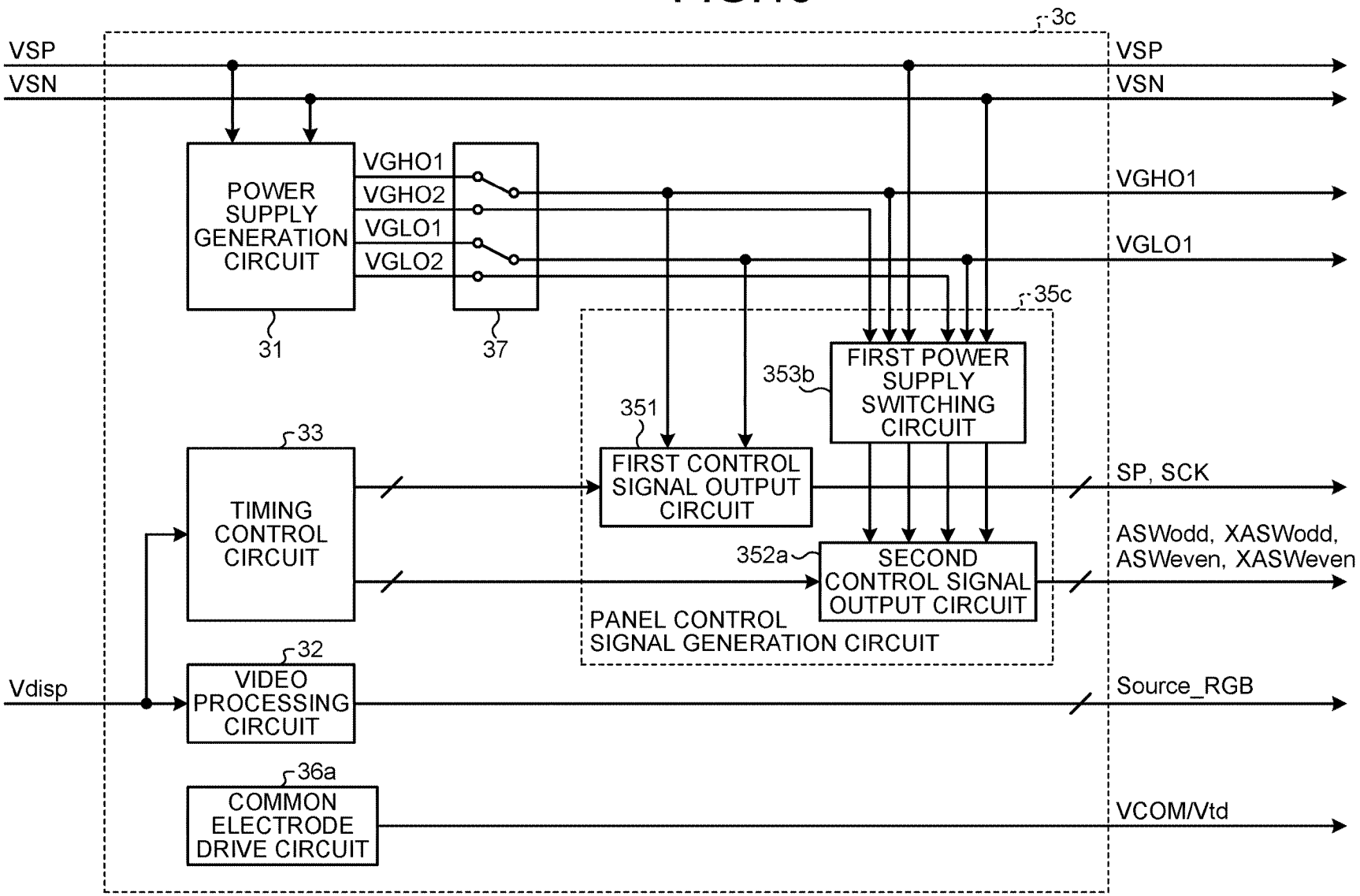
FIG. 19 is a diagram illustrating an example of an internal block configuration of a driver IC of a display device according to a fourth embodiment and a first operation example.
Figure 20:
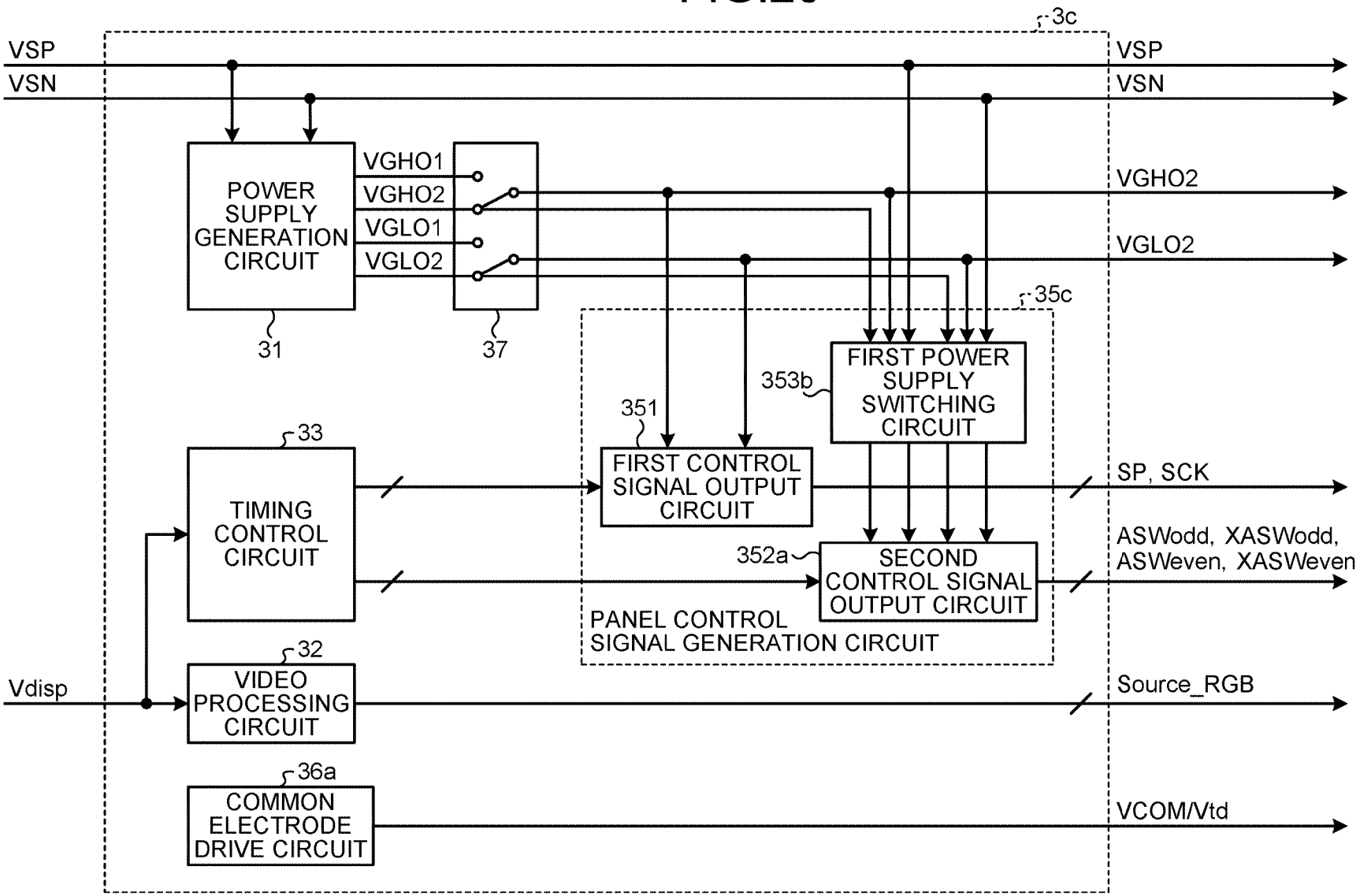
FIG. 20 is a diagram illustrating an example of the internal block configuration of the driver IC of the display device according to the fourth embodiment and a second operation example.

FIG. 19 is a diagram illustrating an example of an internal block configuration of a driver IC of a display device according to a fourth embodiment and a first operation example. FIG. 20 is a diagram illustrating an example of the internal block configuration of the driver IC of the display device according to the fourth embodiment and a second operation example. The same reference numerals denote the components having the same functions as those in the first, second, and third embodiments described above, and the description thereof will be omitted.

In a driver IC 3*c* according to the fourth embodiment, the power supplied during the display period Pd is the same as that in the second embodiment. In other words, during the display period Pd, the second power supply switching circuit 37 supplies the power supplied from the second power supply (second positive power supply (voltage value VGHO1) and second negative power supply (voltage value VGLO1)) to the first control signal output circuit 351 and the gate driver 22 (FIG. 19).

In this process, during the period (n)H, a first power supply switching circuit 353*b* of a panel control signal generation circuit 35*c* supplies the power supplied from the third positive power supply (voltage value VGHO2) and the first negative power supply (voltage value VSN) to the second control signal output circuit 352*a*, as the power supply for the signal selection switch control signals ASWodd and XASWodd. During the period (n)H, the first power supply switching circuit 353*b* also supplies the power supplied from the first positive power supply (voltage value VSP) and the third negative power supply (voltage value VGLO2) to the second control signal output circuit 352*a*, as the power supply for the signal selection switch control signals ASWeven and XASWeven.

During the period (n+1)H, the first power supply switching circuit 353*b* supplies the power supplied from the first positive power supply (voltage value VSP) and the third negative power supply (voltage value VGLO2) to the second control signal output circuit 352*a*, as the power supply for the signal selection switch control signals ASWodd and XASWodd. During the period (n+1)H, the first power supply switching circuit 353*b* also supplies the power supplied from the third positive power supply (voltage value VGHO2) and the first negative power supply (voltage value VSN) to the second control signal output circuit 352*a*, as the power supply for the signal selection switch control signals ASWeven and XASWeven.

In the driver IC 3*c* according to the fourth embodiment, the power supplied during the detection period Pt is the same as that in the third embodiment. In other words, during the detection period Pt, the second power supply switching circuit 37 synchronizes with the drive signal Vtd, toggles power between the second power supply (second positive power supply (voltage value VGHO1) and second negative power supply (voltage value VGLO1)) and the third power supply (third positive power supply (voltage value VGHO2) and third negative power supply (voltage value VGLO2)), and supplies the power to the first control signal output circuit 351 and the gate driver 22 (FIG. 19 and FIG. 20).

In this process, the first power supply switching circuit 353*b* of the panel control signal generation circuit 35*c* controls the power so that the power supplied to the first control signal output circuit 351 and the gate driver 22, is also supplied to the second control signal output circuit 352*a*.

Consequently, the shift clock pulse signal SCK that is the first control signal; the scanning signals GATE (n) and GATE (n+1) generated on the basis of the start pulse signal SP and the shift clock pulse signal SCK that are the first control signals; and the signal selection switch control signals ASWodd, XASWodd, ASWeven, and XASWeven that are the second control signals are signals synchronized with the drive signal Vtd.

In the embodiment described above, the video processing circuit, the timing control circuit, the panel control signal generation circuit, and the common electrode drive circuit are provided in the driver IC. However, these blocks may also be separately formed on the outside of the driver IC as appropriate.

In the second and fourth embodiments described above, the column inversion driving method is used as the driving method of the display device 1. However, the driving methods such as the line inversion driving method, dot inversion driving method, and frame inversion driving method may also be used. In other words, when the pixel signal has a positive polarity, the third positive power supply (voltage value VGHO2) and the first negative power supply (voltage value VSN) are supplied as the power supply for the signal selection switch control signals ASWodd, XASWodd, ASWeven, and XASWeven that are the second control signals. When the pixel signal has a negative polarity, the first positive power supply (voltage value VPN) and the third negative power supply (voltage value VGLO2) are supplied as the power supply for the signal selection switch control signals ASWodd, XASWodd, ASWeven, and XASWeven that are the second control signals. Consequently, it is possible to reduce the switching noise generated by the switching operation of the second control signals (signal selection switch control signals ASWodd, XASWodd, ASWeven, and XASWeven). The third positive power supply (voltage value VGHO2) and the first negative power supply (voltage value VSN) may be supplied as the power supply for the signal selection switch control signals ASWodd, XASWodd, ASWeven, and XASWeven that are the second control signals, only when the pixel signal has a positive polarity. Alternatively, the first positive power supply (voltage value VPN) and the third negative power supply (voltage value VGLO2) may be supplied as the power supply for the signal selection switch control signals ASWodd, XASWodd, ASWeven, and XASWeven that are the second control signals, only when the pixel signal has a negative polarity.

In the embodiments described above, the components may be combined with each other as appropriate. Among other operations and effects derived from the forms described in the present embodiments, it is naturally assumed that those obvious from the description of the present specification, or those easily conceivable by those skilled in the art are provided by the present embodiments.

What is claimed is:

1. A display device, comprising:

a plurality of pixels arranged in a matrix (row-column configuration) in a display area;

a scanning line that is coupled to each of the pixels aligned in a row direction in the display area, and to which a scanning signal is supplied;

a signal line that is coupled to each of the pixels aligned in a column direction in the display area, and to which a pixel signal is supplied;

a gate driver that supplies the scanning signal to the scanning line;

a signal selection circuit that separates the pixel signal that is time-division multiplexed to an image signal;

a first control signal output circuit that outputs a first control signal supplied to the gate driver; and a second control signal output circuit that outputs a second control signal supplied to the signal selection circuit, wherein the gate driver, the first control signal output circuit, and the second control signal output circuit perform a display operation, and a first power supply is supplied to the second control signal output circuit, a second power supply different from the first power supply is supplied to the gate driver and the first control signal output circuit.

2. A display device, comprising:

a plurality of pixels arranged in a matrix (row-column configuration) in a display area;

a scanning line that is coupled to each of the pixels aligned in a row direction in the display area, and to which a scanning signal is supplied;

a signal line that is coupled to each of the pixels aligned in a column direction in the display area, and to which a pixel signal is supplied;

a gate driver that supplies the scanning signal to the scanning line;

a signal selection circuit that separates the pixel signal that is time-division multiplexed to an image signal;

a first control signal output circuit that outputs a first control signal supplied to the gate driver;

a second control signal output circuit that outputs a second control signal supplied to the signal selection circuit and a power supply generation circuit that generates a second power supply by boosting the voltage of the first power supply by a first boosting circuit, and that generates a third power supply different from the second power supply, by boosting the voltage of the first power supply by a second boosting circuit, at least one of the gate driver, the first control signal output circuit, and the second control signal output circuit performs a display operation, when power of a first power supply is supplied, voltage of the first power supply being boosted by a boosting circuit, to perform the display operation, the gate driver and the first control signal output circuit are operated when power of the second power supply is supplied, and the second control signal output circuit is operated when power of a power supply other than the second power supply is supplied, among the first power supply, the second power supply, and the third power supply.

3. The display device according to claim 2, wherein the first power supply includes a first positive power supply and a first negative power supply, the second power supply includes a second positive power supply and a second negative power supply, and the third power supply includes a third positive power supply and a third negative power supply.

4. The display device according to claim 3, wherein the second control signal is a signal for separating the pixel signal that is time-division multiplexed to the image signal, and when the pixel signal has a positive polarity, the second control signal output circuit is operated when power of the third positive power supply and power of the first negative power supply are supplied.

5. The display device according to claim 3, wherein when the pixel signal has a negative polarity, the second control signal output circuit is operated when power of the first positive power supply and power of the third negative power supply are supplied.

6. The display device according to claim 3, wherein a display period during which a display operation is performed and a detection period during which a detection operation is performed are provided, and during the detection period, the gate driver, the first control signal output circuit, and the second control signal output circuit synchronize with a detection drive signal used when the detection operation is performed, and the power of the second power supply and the power of the third power supply are supplied alternately.

7. The display device according to claim 6, wherein a potential difference between voltage of the second positive power supply and voltage of the third positive power supply is substantially equivalent to a peak value of the detection drive signal, and a potential difference between voltage of the second negative power supply and voltage of the third negative power supply is substantially equivalent to the peak value of the detection drive signal.

* * * * *